US009184508B2

(12) United States Patent
Maruyama et al.

(10) Patent No.: US 9,184,508 B2
(45) Date of Patent: Nov. 10, 2015

(54) MULTI-BEAM REFLECTARRAY

(75) Inventors: Tamami Maruyama, Chiyoda-ku (JP); Yasuhiro Oda, Chiyoda-ku (JP); Jiyun Shen, Chiyoda-ku (JP); Ngoc Hao Tran, Chiyoda-ku (JP); Hidetoshi Kayama, Chiyoda-ku (JP)

(73) Assignee: NTT DOCOMO, INC., Tokyo (JP)

( * ) Notice: Subject to any disclaimer, the term of this patent is extended or adjusted under 35 U.S.C. 154(b) by 266 days.

(21) Appl. No.: 13/882,826

(22) PCT Filed: Aug. 15, 2012

(86) PCT No.: PCT/JP2012/070762
§ 371 (c)(1),
(2), (4) Date: May 1, 2013

(87) PCT Pub. No.: WO2013/031539
PCT Pub. Date: Mar. 7, 2013

(65) Prior Publication Data

US 2013/0229296 A1 Sep. 5, 2013

(30) Foreign Application Priority Data

Aug. 29, 2011 (JP) ..... 2011-185848

(51) Int. Cl.
*H01Q 15/14* (2006.01)
*H01Q 3/46* (2006.01)
(Continued)

(52) U.S. Cl.
CPC ..... *H01Q 15/14* (2013.01); *H01Q 1/246* (2013.01); *H01Q 3/46* (2013.01); *H01Q 15/008* (2013.01)

(58) Field of Classification Search
CPC ..... H01Q 15/008; H01Q 15/14; H01Q 1/246; H01Q 3/46
USPC ..... 342/5
See application file for complete search history.

(56) References Cited

U.S. PATENT DOCUMENTS 8,289,220 B2 10/2012 Maruyama et al.
2010/0194657 A1* 8/2010 Maruyama et al. ..... 343/834

FOREIGN PATENT DOCUMENTS

CN 101667669 A 3/2010
EP 2 161 780 A1 3/2010
JP 2009-207078 A 9/2009

OTHER PUBLICATIONS

Maruyama, T., et al., "Experiment and Analysis of Reflect Beam Direction Control using a Reflector having Periodic Tapered Mushroom-like Structure," ISAP2008, MO-IS1, Total 4 Pages, (2008).
(Continued)

*Primary Examiner* — Timothy A Brainard
(74) *Attorney, Agent, or Firm* — Oblon, McClelland, Maier & Neustadt, L.L.P.

(57) ABSTRACT

A multi-beam reflectarray includes two or more element arrays including plural elements aligned along a predetermined direction. The multi-beam reflectarray is such that, in each of a first element group and a second element group included in at least one of the element arrays, a difference between phases of radio waves reflected by corresponding two elements is in proportion to a first product of a distance between the two elements and a value of a trigonometric function with respect to an angle of reflection by the two elements, and a distance between neighboring elements in the first element group is equal to a product of a rational number and a distance between neighboring elements in the second element group.

12 Claims, 39 Drawing Sheets

(51) Int. Cl.
*H01Q 15/00* (2006.01)
*H01Q 1/24* (2006.01)

(56) References Cited

OTHER PUBLICATIONS

Huang, J., et al., "Reflectarray Antennas," IEEE Press, pp. 169-179, (2007).
International Search Report Issued Oct. 9, 2012 in PCT/JP12/70762 Filed Aug. 15, 2012.
Combined Chinese Office Action and Search Report issued Jun. 30, 2014 in Patent Application No. 201280004162.1 (with partial English translation and English translation of categories of cited documents).
Extended Search Report issued Dec. 15, 2014 in European Patent Application No. 12827331.5.
José A, Encinar, et al., "Three-Layer Printed Reflectarrays for Contoured Beam Space Applications", IEEE Transactions on Antennas and Propagation, XP11112388, vol. 52, No. 5., May 2004, pp. 1138-1148.
Payam Nayeri, et al., "Single-Feed Multi-Beam Reflectarray Antennas", Antennas and Propagation Society International Symposium, Jul. 11, 2010, XP031745996, 4 pages.
Kihun Chang, et al., ".High-impedance Surface with Nonidentical Lattices", Antenna Technologies: Small Antennas and Novel Materials, Mar. 4, 2008, XP031248634, pp. 474-477.

* cited by examiner

FIG.10

| COMBINATION NUMBER OF ELEMENT NUMBERS | NUMBER OF DIVISIONS | | CONTROL ANGLE | | PHASE DIFFER-ENCE [Deg] | PHASE DIFFER-ENCE [Deg] | NUMBER OF ELEMENTS IN ONE PERIOD FOR α1 CONTROL | NUMBER OF ELEMENTS IN ONE PERIOD FOR α2 CONTROL | NUMBER OF ELEMENTS IN ONE PERIOD OF COMBINED ARRAY FOR MULTI-BEAMS OF α1 AND α2 |
|---|---|---|---|---|---|---|---|---|---|
| No. | nk1 | nk2 | α1 | α2 | $\Delta\phi_1$ | $\Delta\phi_2$ | | | |
| 1 | 10 | 10 | 70 | 70 | 36 | 36 | 10 | 10 | 10 |
| 2 | 10 | 12 | 70 | 51.543 | 36 | 30 | 10 | 12 | 60 |
| 3 | 12 | 12 | 70 | 70 | 30 | 30 | 12 | 12 | 12 |
| 4 | 10 | 15 | 70 | 38.79 | 36 | 24 | 10 | 15 | 30 |
| 5 | 12 | 15 | 70 | 48.743 | 30 | 24 | 12 | 15 | 60 |
| 6 | 15 | 15 | 70 | 70 | 24 | 24 | 15 | 15 | 15 |
| 7 | 10 | 18 | 70 | 31.47 | 36 | 20 | 10 | 18 | 90 |
| 8 | 12 | 18 | 70 | 38.79 | 30 | 20 | 12 | 18 | 36 |
| 9 | 15 | 18 | 70 | 51.543 | 24 | 20 | 15 | 18 | 90 |
| 10 | 18 | 18 | 70 | 70 | 20 | 20 | 18 | 18 | 18 |
| 11 | 10 | 20 | 70 | 28.024 | 36 | 18 | 10 | 20 | 20 |
| 12 | 12 | 20 | 70 | 34.32 | 30 | 18 | 12 | 20 | 60 |
| 13 | 15 | 20 | 70 | 44.811 | 24 | 18 | 15 | 20 | 60 |
| 14 | 18 | 20 | 70 | 57.75 | 20 | 18 | 18 | 20 | 180 |
| 15 | 20 | 20 | 70 | 70 | 18 | 18 | 20 | 20 | 20 |
| 16 | 10 | 24 | 70 | 23.05 | 36 | 15 | 10 | 24 | 120 |
| 17 | 12 | 24 | 70 | 28.024 | 30 | 15 | 12 | 24 | 24 |
| 18 | 15 | 24 | 70 | 35.966 | 24 | 15 | 15 | 24 | 120 |
| 19 | 18 | 24 | 70 | 44.811 | 20 | 15 | 18 | 24 | 72 |
| 20 | 20 | 24 | 70 | 51.543 | 18 | 15 | 20 | 24 | 120 |
| 21 | 24 | 24 | 70 | 70 | 15 | 15 | 24 | 24 | 24 |
| 22 | 10 | 30 | 70 | 18.254 | 36 | 12 | 10 | 30 | 30 |
| 23 | 12 | 30 | 70 | 22.079 | 30 | 12 | 12 | 30 | 60 |
| 24 | 15 | 30 | 70 | 28.024 | 24 | 12 | 15 | 30 | 30 |
| 25 | 18 | 30 | 70 | 34.32 | 20 | 12 | 18 | 30 | 90 |
| 26 | 20 | 30 | 70 | 38.79 | 18 | 12 | 20 | 30 | 60 |
| 27 | 24 | 30 | 70 | 48.743 | 15 | 12 | 24 | 30 | 120 |
| 28 | 30 | 30 | 70 | 70 | 12 | 12 | 30 | 30 | 30 |
| 29 | 10 | 36 | 70 | 15.131 | 36 | 10 | 10 | 36 | 180 |
| 30 | 12 | 36 | 70 | 18.254 | 30 | 10 | 12 | 36 | 36 |
| 31 | 15 | 36 | 70 | 23.05 | 24 | 10 | 15 | 36 | 180 |
| 32 | 18 | 36 | 70 | 28.024 | 20 | 10 | 18 | 36 | 36 |
| 33 | 20 | 36 | 70 | 31.47 | 18 | 10 | 20 | 36 | 180 |
| 34 | 24 | 36 | 70 | 38.79 | 15 | 10 | 24 | 36 | 72 |
| 35 | 30 | 36 | 70 | 51.543 | 12 | 10 | 30 | 36 | 180 |
| 36 | 36 | 36 | 70 | 70 | 10 | 10 | 36 | 36 | 36 |

MULTI-BEAM REFLECTARRAY

TECHNICAL FIELD

The present invention relates to a multi-beam reflectarray.

BACKGROUND ART

In radio communication, when an obstacle, such as a building, exists on a propagation path of a radio wave, a reception level is lowered. For this reason, there has been a technique for transmitting a reflected wave to a location difficult for a radio wave to reach by disposing a reflection plate (reflector) at a high place, where a height of the high place is greater than or equal to that of the building. In a case where a radio wave is reflected by a reflector, when an angle of incidence of the radio wave in a vertical plane is relatively small, it is difficult for the reflector to direct the radio wave to a desired direction (FIG. 1). That is because, in general, an angle of incidence of a radio wave is equal to an angle of reflection. To address this problem, it can be considered to incline the reflector, so that the reflector faces a ground surface. The angle of incidence and the angle of reflection relative to the reflector can be enlarged by doing so. In this manner, an incident wave can be directed to a desired direction. However, from a viewpoint of safety, it is not preferable to incline the reflector toward the ground surface, because the reflector is disposed at the high place comparable to the height of the building that blocks the radio wave. From such a point of view, a reflector has been desired such that an angle of incidence of a radio wave is different from an angle of reflection of the radio wave. Namely, a reflector has been desired such that, even if an angle of incidence is relatively small, a reflected wave can be directed to a desired direction. A conventional reflector has been described in Non-Patent Document 1, for example. In the reflector, an angle of reflection of a radio wave is attempted to be controlled by causing plural elements to form corresponding reflected waves having a predetermined reflection phase. Since this type of reflector includes plural elements, this type of reflector may be referred to as a "reflectarray."

In a mobile communication system, when communication quality in an area is to be improved by using a reflectarray, it can be considered to enlarge an area of the reflectarray, so that a reception level of a reflected wave becomes greater. However, when a size or the area of the reflectarray is simply enlarged, a beam width of the reflected wave becomes smaller, though the intensity of the reflected wave is increased. A problem is that the area in which communication quality can be improved becomes narrow. When the size of the reflectarray is small, the beam width of the reflected wave becomes relatively large. Unfortunately, the reception level of the reflected wave becomes small.

As for such problems, an attempt has been made to reflect an incident radio wave in plural directions (Non-Patent Document 2). Unfortunately, the method described in Non-Patent Document 2 is not for directing the reflected wave in an arbitrarily desired direction. Thus, it is possible that, in an area where a radio wave environment is to be improved, the communication quality is not sufficiently improved.

RELATED ART DOCUMENT

Non-Patent Document

Non-Patent Document 1: T. Maruyama, T. Furuno, and S. Uebayashi, "Experiment and analysis of reflect beam direction control using a reflector having periodic tapered mushroom-like structure," ISAP2008, MO-IS1, 1644929, p. 9.

Non-Patent Document 2: John Huang, Jose A. Encinar, "Reflectarray" pp. 169-179, IEEE Press, 2007.

SUMMARY OF THE INVENTION

Problem to be Solved by the Invention

The problem to be solved by the present invention is to provide a multi-beam reflectarray that can reflect an incident radio wave in plural desired directions.

Means for Solving the Problem

A multi-beam reflectarray according to one embodiment is a multi-beam reflectarray including two or more element arrays, each of the element arrays including plural elements aligned along a predetermined direction, wherein, in each of a first element group and a second element group included in the two or more element arrays, a difference between phases of radio waves reflected by corresponding two elements is proportional to a first product of a distance between the two elements and a value of a trigonometric function with respect to an angle of reflection by the elements, and wherein a first distance between two neighboring elements in the first element group is equal to a second product of a rational number and a second distance between two neighboring elements in the second element group.

Effect of the Present Invention

According to the embodiments, there can be provided the multi-beam reflectarray that can reflect an incident radio wave in plural desired directions.

BRIEF DESCRIPTION OF THE DRAWINGS

FIG. 10 is a diagram showing specific numerical examples of parameters;

EMBODIMENTS FOR CARRYING OUT THE INVENTION

Figure 1:
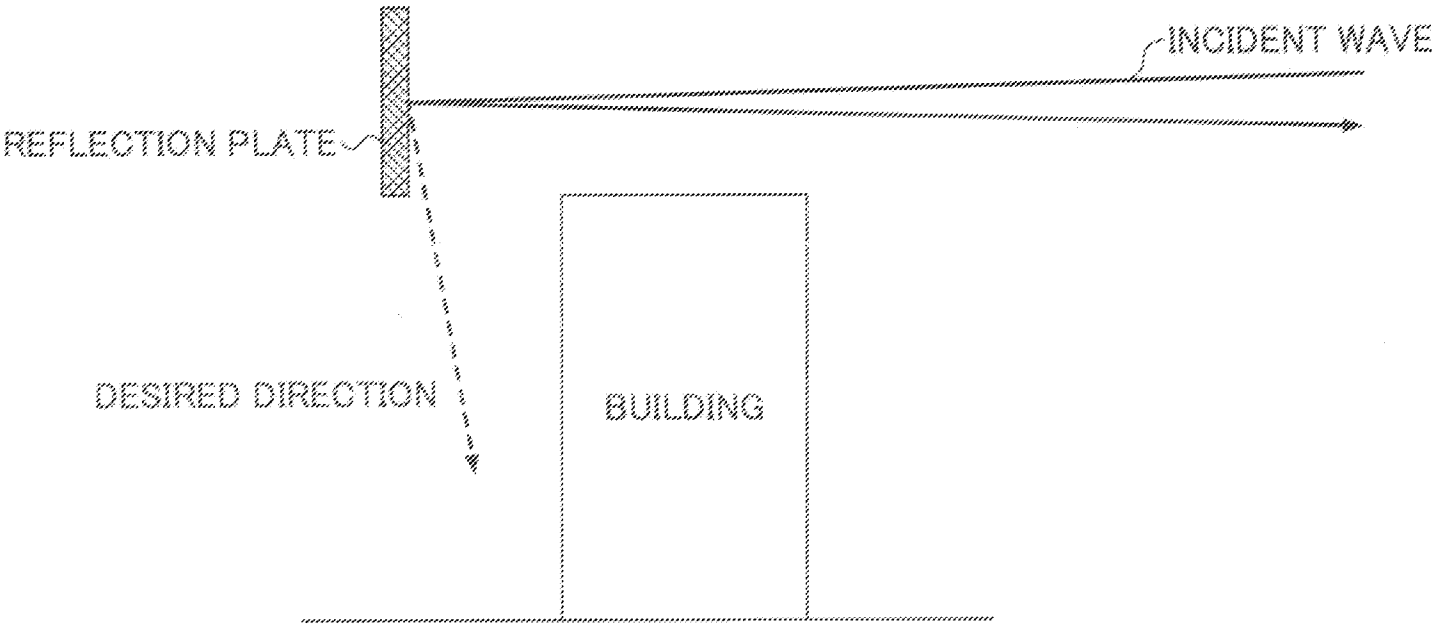
FIG. 1 is a diagram illustrating a conventional problem.

A multi-beam reflectarray according to an embodiment can reflect an incident radio wave in plural desired control angle directions ($\alpha_1, \alpha_2, \ldots, \alpha_J$). With this, in an area where the reflected wave is to be received, a beam strength and a beam width are suitably secured. In this regard, it is greatly different from a conventional reflectarray that can only reflect a strong and narrow beam or a weak and broad beam in a single direction.

Hereinafter, the embodiment is explained while referring to the accompanying drawings. In the drawings, identical reference numerals or reference symbols are attached to the same elements. The embodiment will be explained from the following viewpoints.

1. Principle of the reflectarray
2. Principle of the multi-beam reflectarray
3. Reflection phases of elements in the multi-beam reflectarray
4. Simulation
5. Modified examples
5.1 An alternative example of the elements
5.2 Shifting a graph
5.3 Examples of arrangements of the elements

First Embodiment

1. Principle of the Reflectarray

Prior to explaining the multi-beam reflectarray according to the embodiment, there is explained a generic operating principle of the reflectarray.

Figure 2:
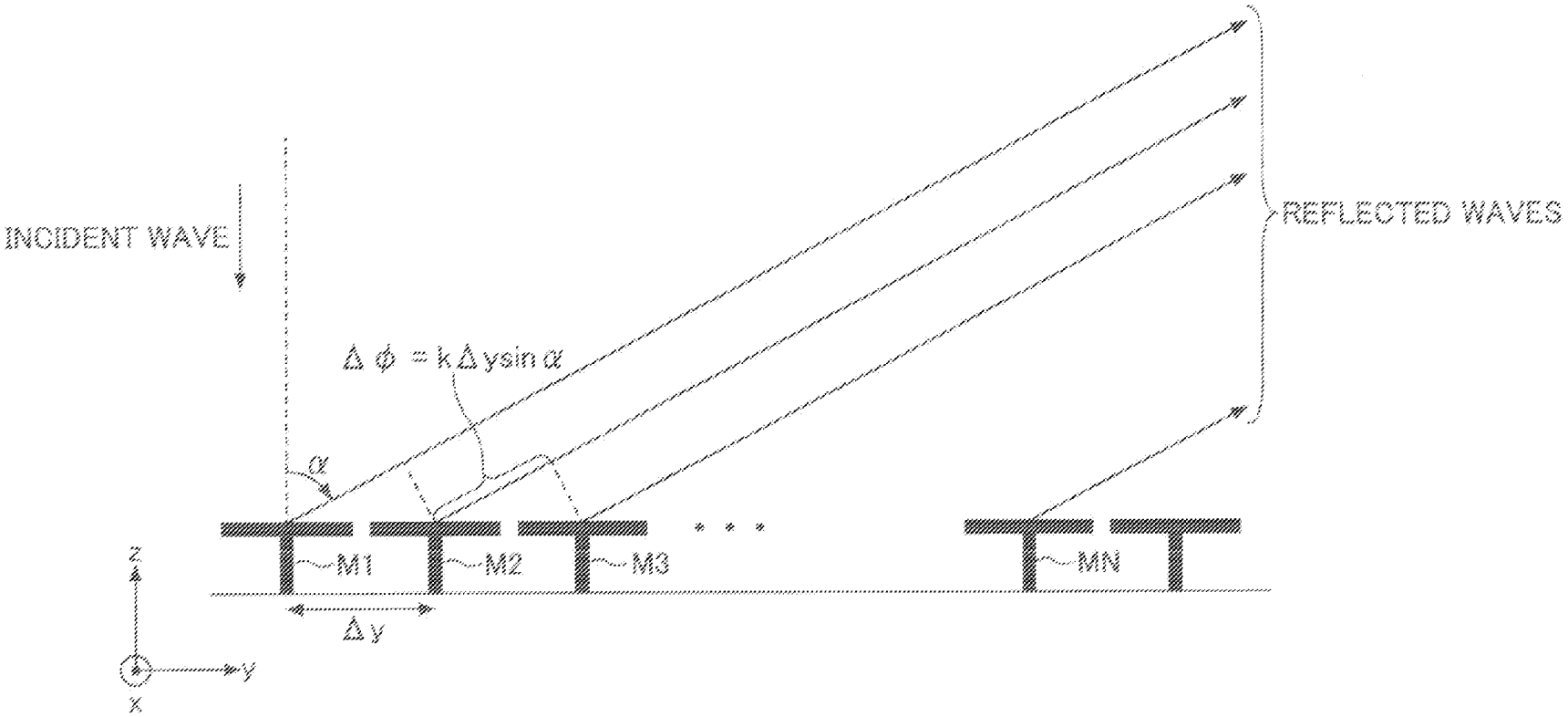
FIG. 2 is a diagram illustrating a reflectarray.
Figure 3:
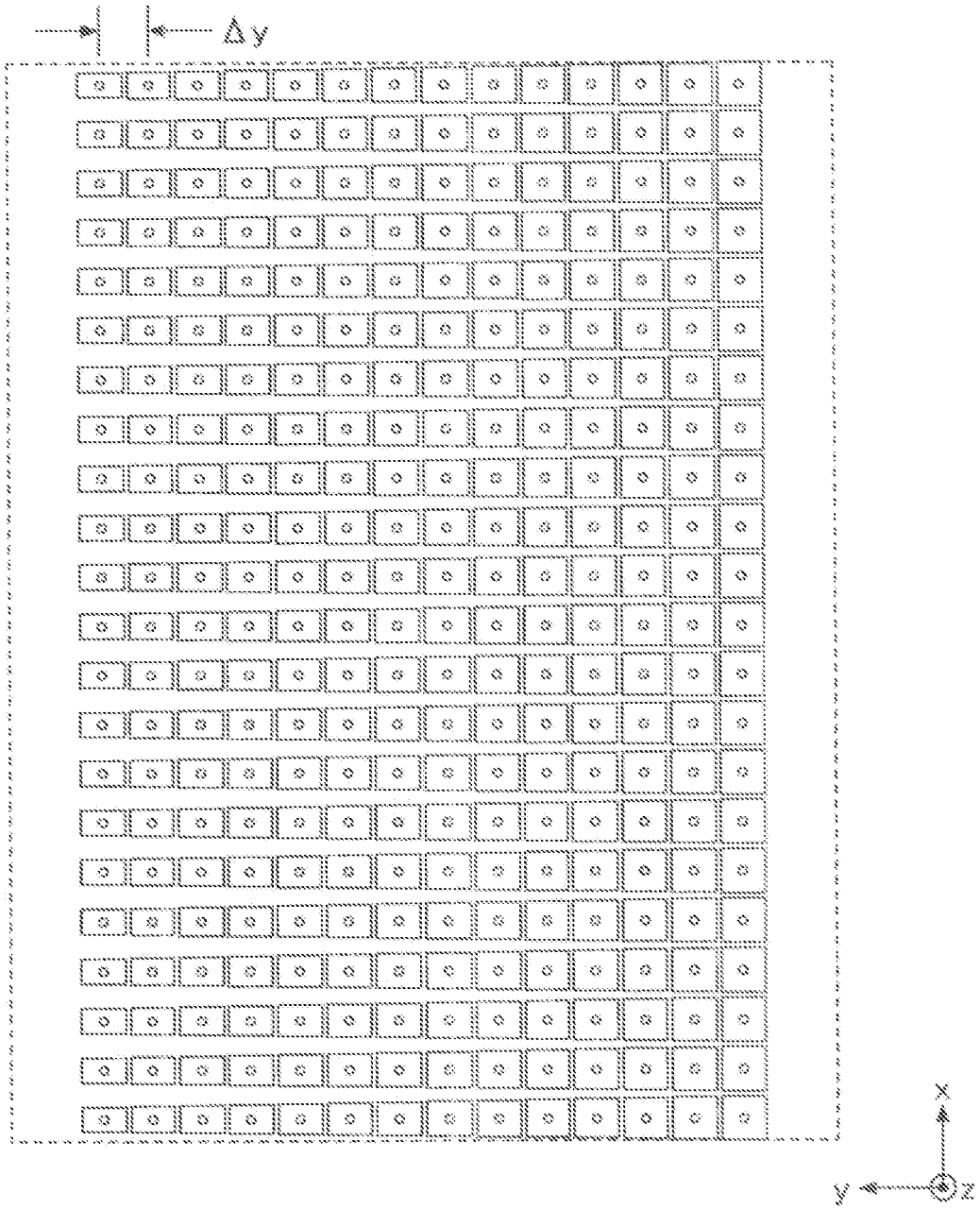
FIG. 3 is a plan view of the reflectarray.

FIG. 2 is a diagram illustrating the reflectarray. The reflectarray shown in the figure includes plural elements from M1 to MN which are arranged in a y-axis direction. In the reflectarray, structures which are similar to the N pieces of elements are repeatedly arranged in the y-axis direction and in an x-axis direction. FIG. 3 is a plan view of the reflectarray. Each of the elements is a component that reflects a radio wave. In the example shown in the figure, each of the elements is a mushroom-like structure. This point is described later. Radio waves come from the infinity direction of a z-axis, and the radio waves are reflected while forming an angle $\alpha$ with respect to the z-axis. When the distance between the neighboring elements is assumed to be $\Delta y$, a phase difference $\Delta\phi$ and an angle of reflection $\alpha$ of the reflected waves by these elements satisfy the expressions below.

$$\Delta\phi = k \times \Delta y \times \sin(\alpha)$$

$$\alpha = \sin^{-1}[(\lambda\Delta\phi)/(2\pi\Delta y)]$$

Figure 4:
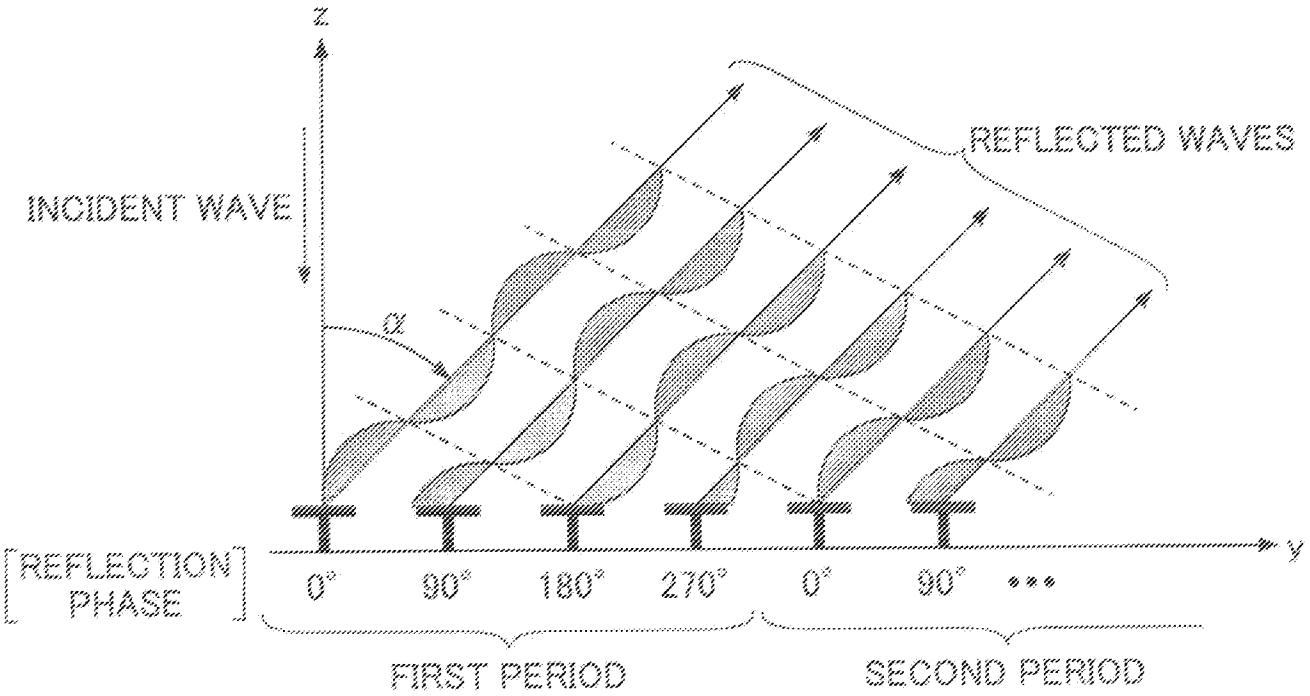
FIG. 4 is a diagram showing a situation where radio waves are reflected with suitable reflection phases.

Here, k is the wavenumber, and k is equal to $2\pi/\lambda$. The wavelength of the radio wave is denoted by $\lambda$. When a reflectarray that is sufficiently larger than the wavelength is to be formed, it is preferable to set reflection phases of the corresponding individual elements such that a difference in the reflection phase $N \times \Delta\phi$ by the whole of the N pieces of the elements from M1 to MN which are arranged in the y-axis direction is equal to 360 degrees ($2\pi$ radians). For example, when N is equal to 4, $\Delta\phi = 360/4 = 90$ degrees. Accordingly, at least theoretically, a reflectarray that reflects a radio wave in a direction of the angle $\alpha$ can be achieved by designing elements, so that a difference in the reflection phase between the neighboring elements becomes 90 degrees, and by repeatedly arranging structures two-dimensionally, where in each of the structures, 4 pieces of the elements are arranged. FIG. 4 schematically shows reflected waves in a case where a difference in the phase between the neighboring elements is 90 degrees. A desired reflectarray can be achieved by forming periodic structures while regarding the four elements as one structure. Here, each of the elements shifts the reflection phase by 90 degrees. In FIG. 4, equiphase surfaces are shown by broken lines.

Figure 5:
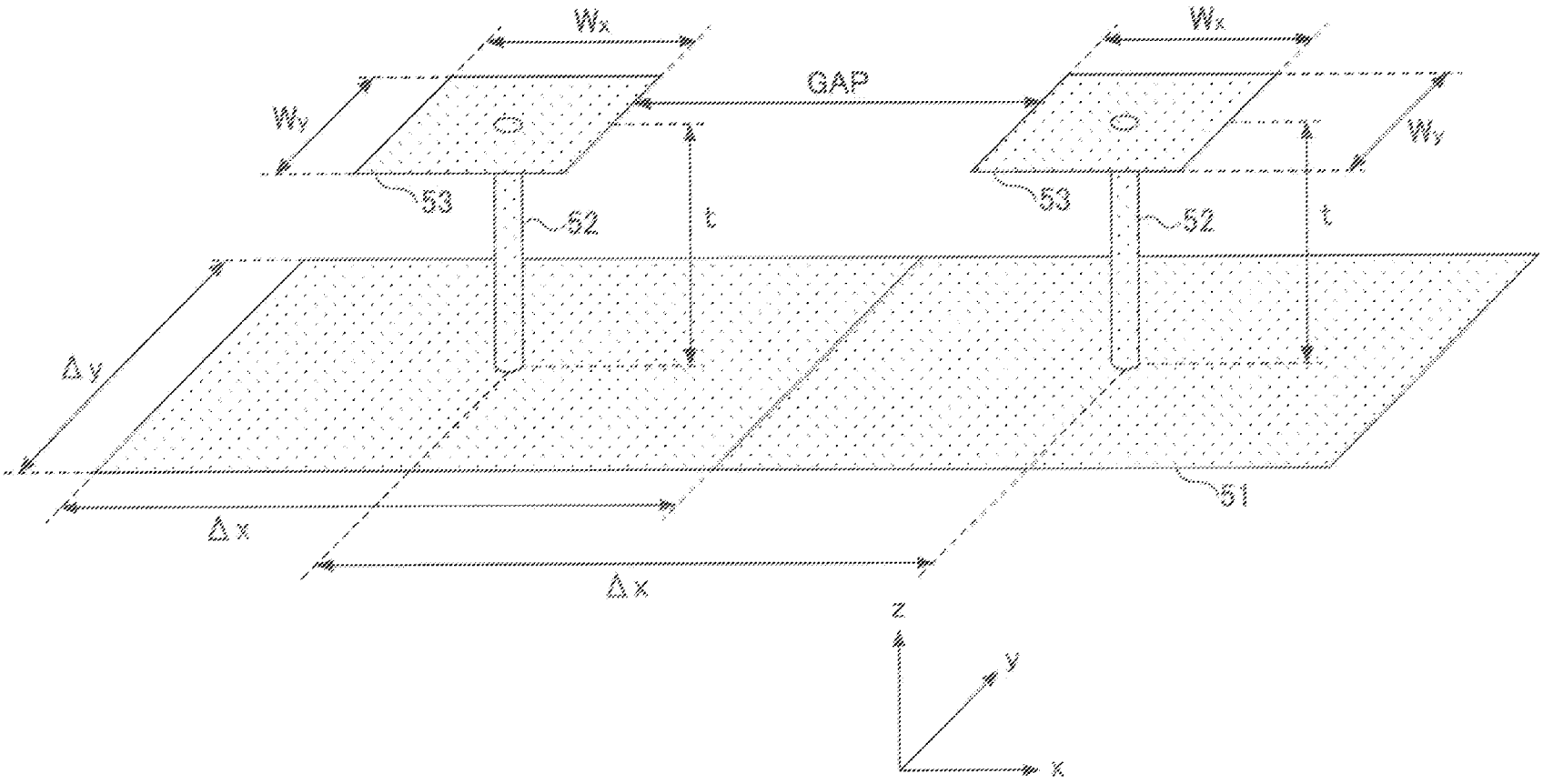
FIG. 5 is a diagram showing mushroom-like structures that can be used as elements forming the reflectarray.

FIG. 5 shows the mushroom-like structures that can be used as the elements of the reflectarray in FIGS. 2-4. The mushroom-like structure includes a ground plate 51; a via 52; and a patch 53.

The ground plate 51 is a conductor that applies a common electric potential to the plural mushroom-like structures. Distances between the neighboring mushroom-like structures in the x-axis direction and in the y-axis direction are indicated by Δx and Δy, respectively. The Δx and Δy represent a size of the ground plate 51 corresponding to one mushroom-like structure. In general, the ground plate 51 is large, comparable to an array in which a large number of mushroom-like structures are arranged.

The via 52 is provided to electrically short-circuit the ground plate 51 and the patch 53.

The patch 53 has a length Wx in the x-axis direction and a length Wy in the y-axis direction. The patch 53 is arranged in parallel with the ground plate 51, while the patch 53 is spaced apart from the ground plate 51 by a distance t. The patch 53 is short-circuited to the ground plate 51 through the via 52.

For simplicity of illustration, only two mushroom-like structures are shown in FIG. 5. In the reflectarray, a large number of such mushroom-like structures are arranged in the x-axis direction and in the y-axis direction.

Figure 6:
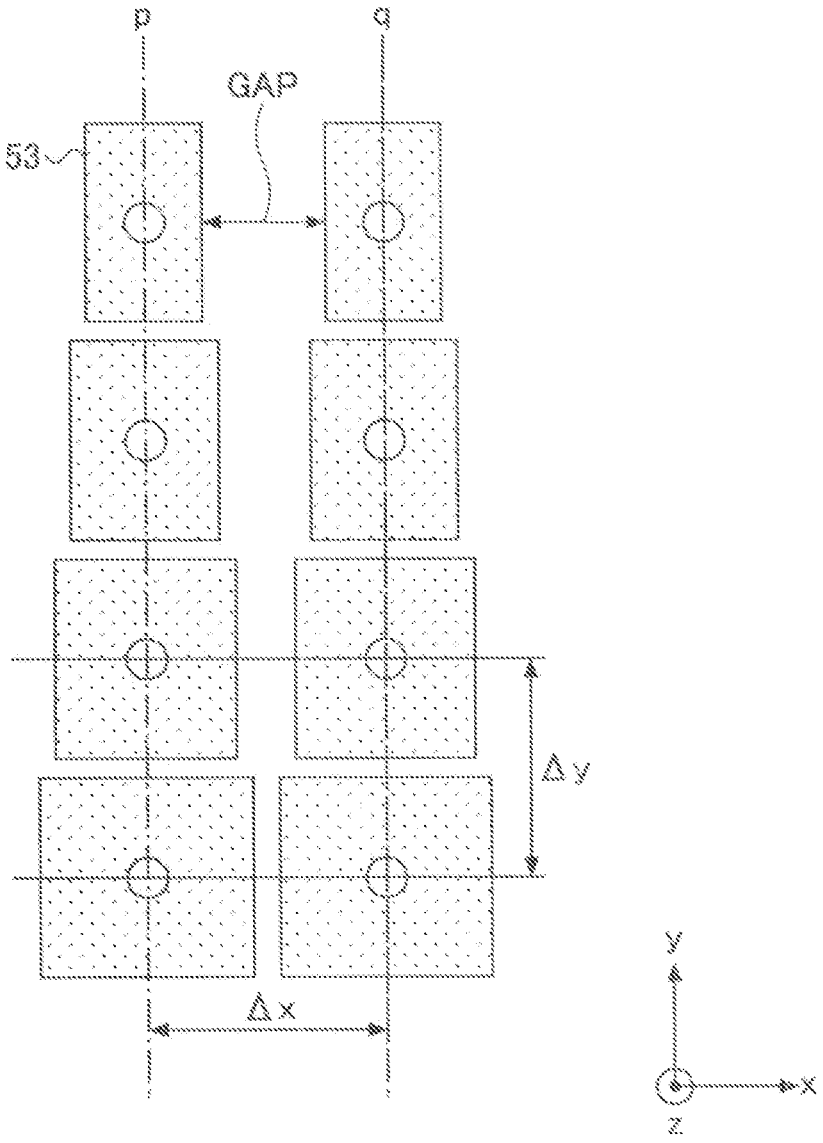
FIG. 6 is an enlarged plan view of the reflectarray.

FIG. 6 is a magnified plan view of the reflectarray shown in FIGS. 3-5. There are shown the four patches 53 arranged in a sequence along a line p and the other four patches 53 neighboring the sequence and arranged along a line q. The number of the patches 53 is arbitrary.

Figure 7:
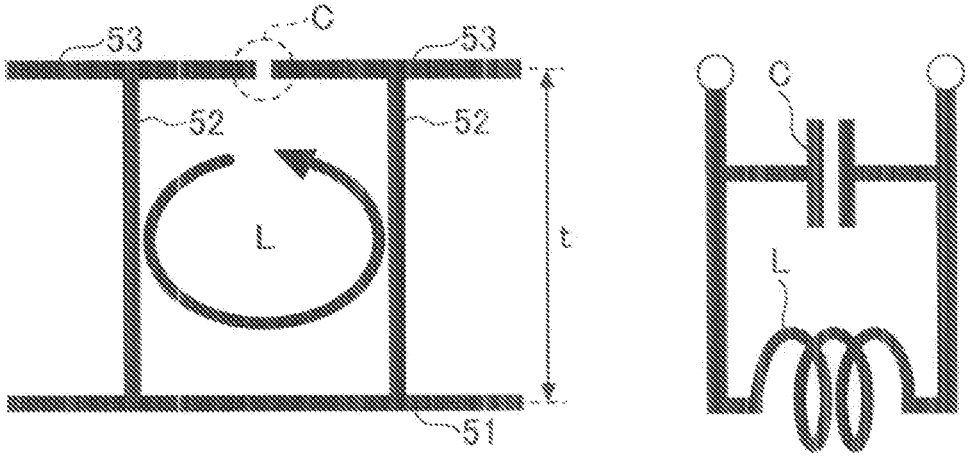
FIG. 7 is a diagram of equivalent circuits of the mushroom-like structures.

FIG. 7 shows equivalent circuits of the mushroom-like structures shown in FIGS. 3, 5, and 6. As shown in FIG. 7, a capacitance C occurs due to a gap between the patches 53 of the mushroom-like structures arranged along the line p and the other patches 53 of the mushroom-like structures arranged along the line q. Further, an inductance L occurs due to the vias 52 of the mushroom-like structures arranged along the line p and the other vias 52 of the mushroom-like structures arranged along the line q. Accordingly, the equivalent circuit of the neighboring mushroom-like structures becomes a circuit such as shown in the right side of FIG. 7. Namely, in the equivalent circuit, the inductance L and the capacitance C are connected in parallel. The capacitance C, the inductance L, a surface impedance Zs, and a reflection coefficient Γ can be expressed as follows.

[Expression 1]

$$C = \frac{\varepsilon_0(1+\varepsilon_r)W_y}{\pi}\operatorname{arccosh}\left(\frac{\text{distance between elements}}{\text{gap}}\right) \quad (1)$$

$$L = \mu \cdot t \quad (2)$$

$$Z_s = \frac{j\omega L}{1-\omega^2 LC} \quad (3)$$

$$\Gamma = \frac{Z_s - \eta}{Z_s + \eta} = |\Gamma|\exp(j\varphi) \quad (4)$$

In the formula (1), $\in_0$ represents the dielectric constant of vacuum, and $\in_r$ represents a relative dielectric constant of a material disposed between the patches. In the above-described example, the distance between the elements is the distance between the vias Δx in the x-axis direction. The gap is the space between the neighboring patches, and in the above-described example, the gap is (Δx−Wx). Wx represents a length of the patch in the x-axis direction. Namely, an argument of the arc cos h function represents a ratio between the distance between the elements and the gap. In the formula (2), μ represents a magnetic permeability of a material disposed between the vias, and t represents a height of the patch 53 (a distance from the ground plate 51 to the patch 53). In the formula (3), ω represents an angular frequency, and j represents an imaginary unit. In the formula (4), η represents the free space impedance, and ϕ represents a phase difference.

Figure 8:
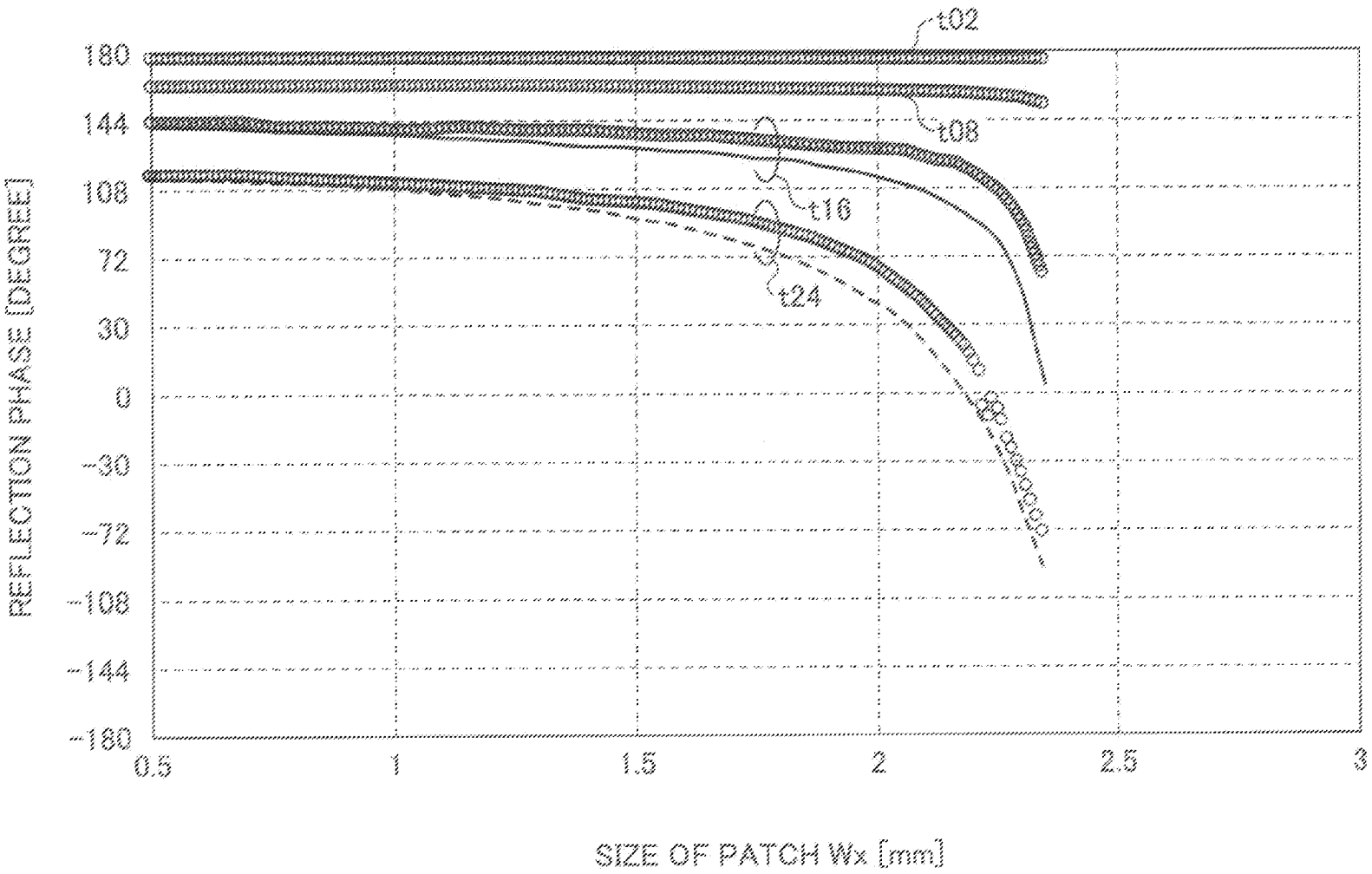
FIG. 8 is a diagram showing a relationship between a patch size and a reflection phase.

FIG. 8 shows a relationship between the size Wx of the patch of the mushroom-like structure shown in FIG. 5 and the reflection phase. In general, the reflection phase of the mushroom-like structure (element) becomes zero at a resonant frequency. The resonant frequency is determined by the capacitance C and the inductance L. Thus, for designing the reflectarray, the capacitance C and the inductance L are suitably set, so that suitable reflection phases are achieved by the corresponding elements. In the figure, the solid lines indicate theoretical values, and the lines plotted by white circles indicate simulated values. FIG. 8 shows, for four kinds of the heights of the via or the thicknesses t of the substrate, corresponding relationships between the size Wx of the patch and the reflection phase. The graph for a case where the distance t is 0.2 mm is represented by t02. The graph for a case where the distance is 0.8 mm is represented by t08. The graph for a case where the distance is 1.6 mm is represented by t16. The graph for a case where the distance is 2.4 mm is represented by t24. For example, the distances between the vias Δx and Δy are 2.4 mm, respectively.

It can be found from the graph t02 that the reflection phase around 175 degrees can be achieved by setting the thickness to be 0.2 mm. When the size Wx of the patch is varied from 0.5 mm to 2.3 mm, a difference in the reflection phase is less than or equal to 1 degree, and the value of the reflection phase almost does not change. From the graph t08, the reflection phase around 160 degrees can be achieved by setting the thickness to be 0.8 mm. In this case, when the size Wx of the patch is varied from 0.5 mm to 2.3 mm, the reflection phase is varied from about 162 degrees to 148 degrees. However, the range of the variation is 14 degrees, which is small. From the graph t16, the reflection phase becomes less than or equal to 145 degrees by setting the thickness to be 1.6 mm. When the size Wx of the patch is varied from 0.5 mm to 2.1 mm, the reflection phase slowly decreases from 144 degrees to 107 degrees. When the size Wx of the patch becomes greater than 2.1 mm, the reflection phase rapidly decreases. When the size Wx of the patch is 2.3 mm, the simulation value (the white circle) of the reflection phase reaches 54 degrees, and the theoretical value (the solid line) of the reflection phase reaches 0 degrees. For the case of the graph t24, when the size Wx of the patch varies from 0.5 mm to 1.7 mm, the reflection phase slowly decreases from 117 degrees to 90 degrees. When the size Wy becomes greater than 1.7 mm, the reflection phase rapidly decreases. When the size Wx is 2.3 mm, the reflection phase reaches −90 degrees.

When the elements are formed by the mushroom-like structures shown in FIGS. 5 and 6, the sizes Wy of the patches in the y-axis direction are the same for all the elements, but the sizes Wx of the patches in the x-axis direction are different depending on the position. It is not required that the sizes Wy of the patches be common for all the elements. The sizes Wy of the patches may be designed, so that the size Wy depends on the patch. For a case where a reflectarray is designed by using the mushroom-like structures in which the sizes Wy of the patches are the same for all the elements, the design is simplified, and it suffices that the sizes Wx of the patches in the x-axis direction are determined depending on the positions of the elements. Specifically, the height or thickness that is used for designing (e.g., t24) is selected among various heights of the via or thicknesses of the substrate, and the each of the sizes of the aligned plural patches is determined depending on a reflection phase which is required at the position of the patch. For example, for a case where t24 is selected, when a reflection phase required at a position of a patch is 72 degrees, the size Wx of the patch is approximately 2 mm. Similarly, the sizes of other patches are determined. Ideally, it is preferable that the patch sizes be designed, so that the change in the reflection phase by the whole of one element group which is aligned in the reflectarray is 360 degrees.

Figure 26:
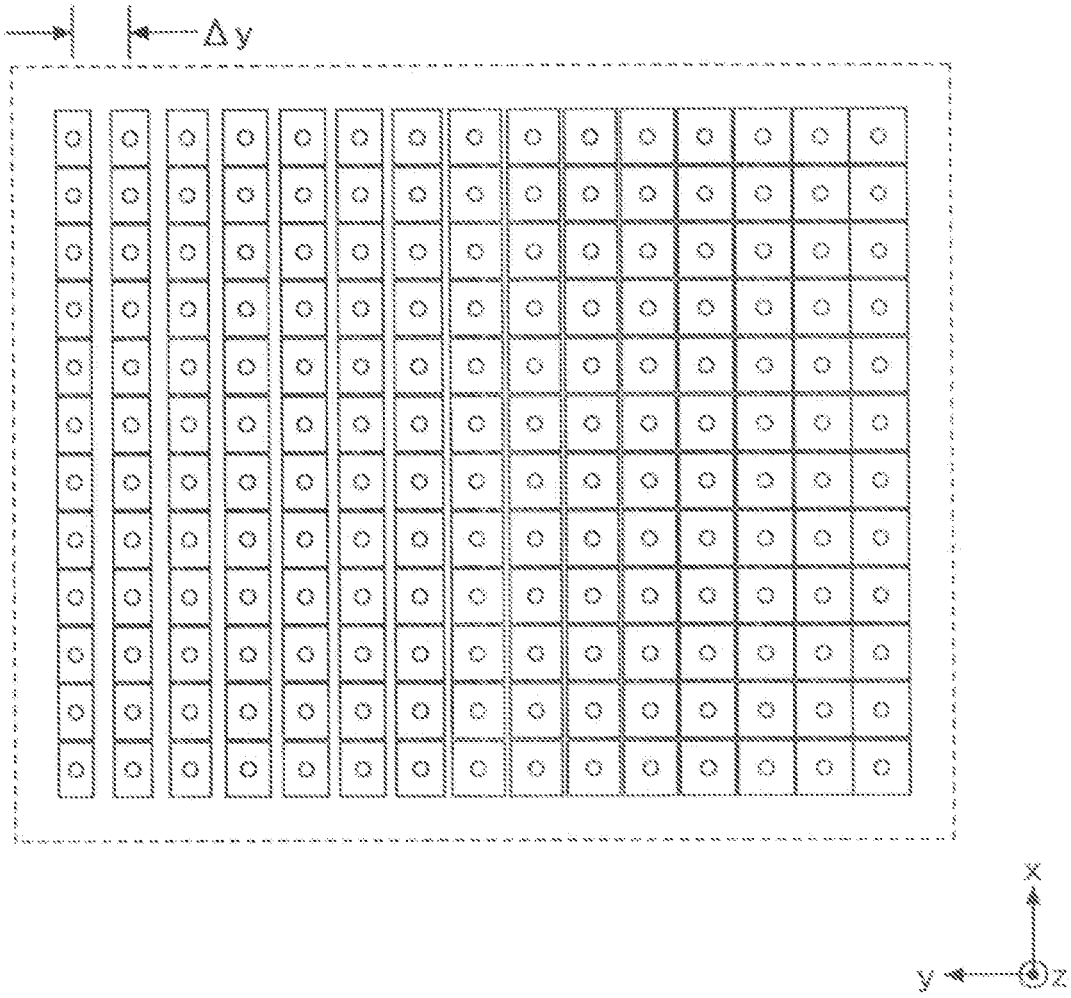
FIG. 26 is a plan view of another reflectarray.
Figure 27:
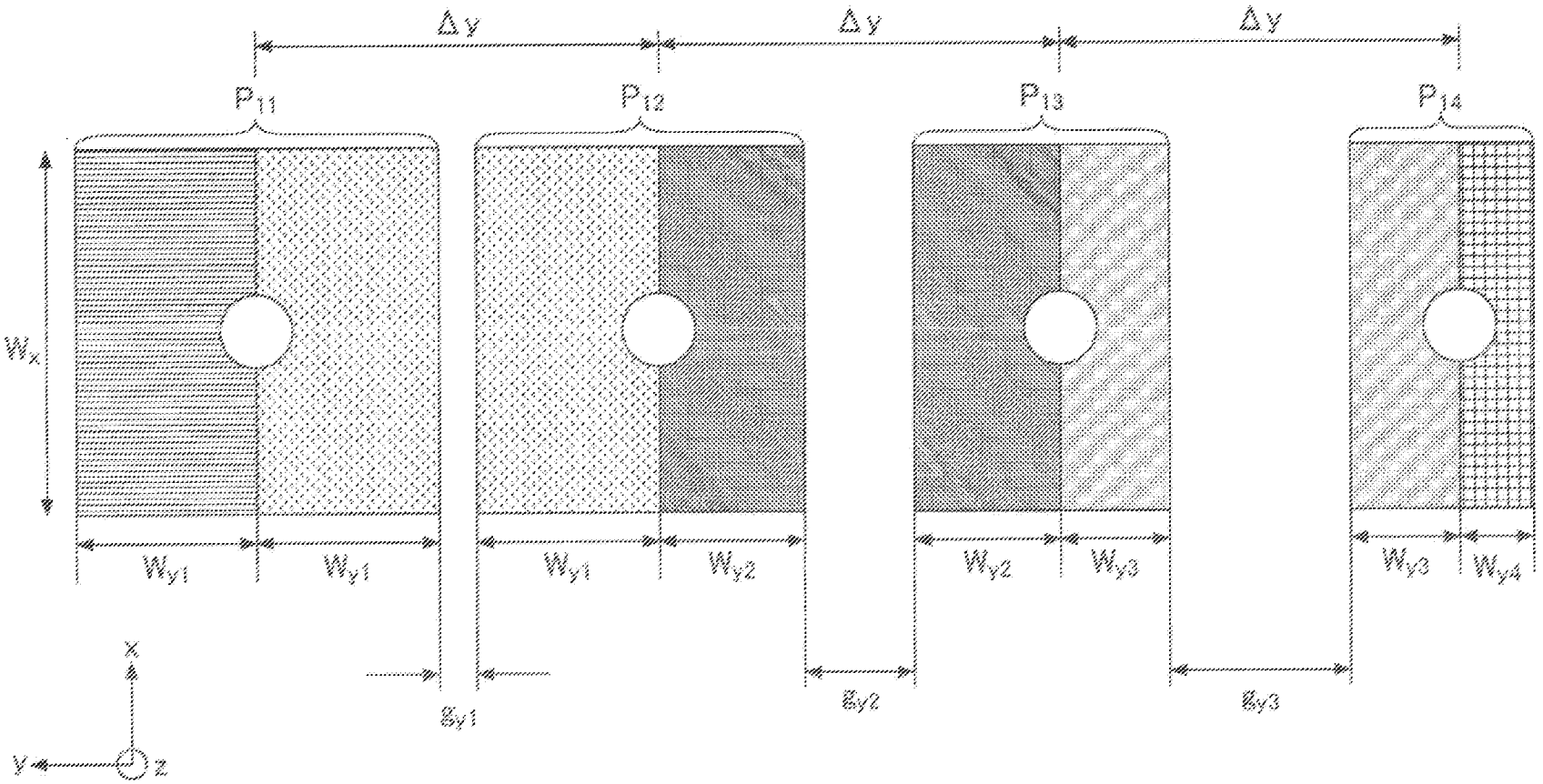
FIG. 27 is an enlarged plan view of an example of the reflectarray shown in FIG. 26.
Figure 28:
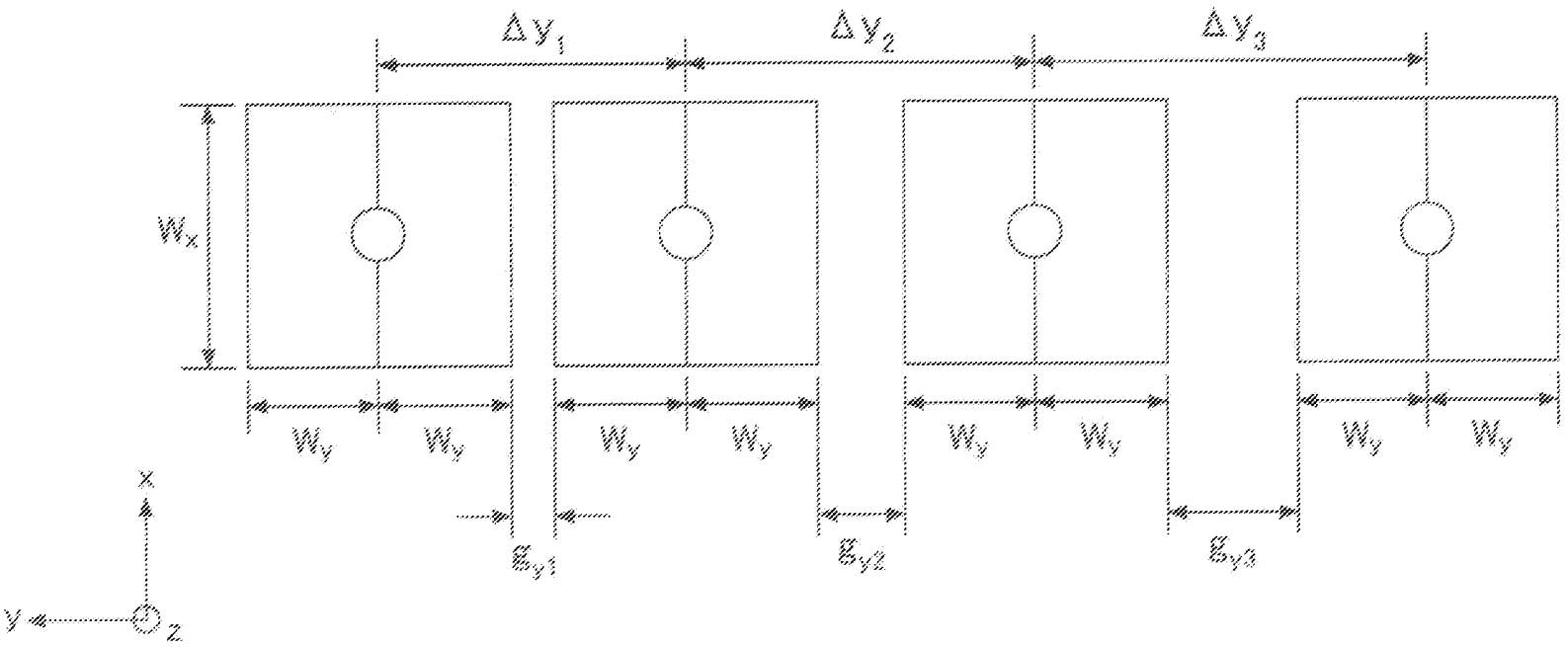
FIG. 28 is an enlarged plan view of another example of the reflectarray shown in FIG. 26.
Figure 29:
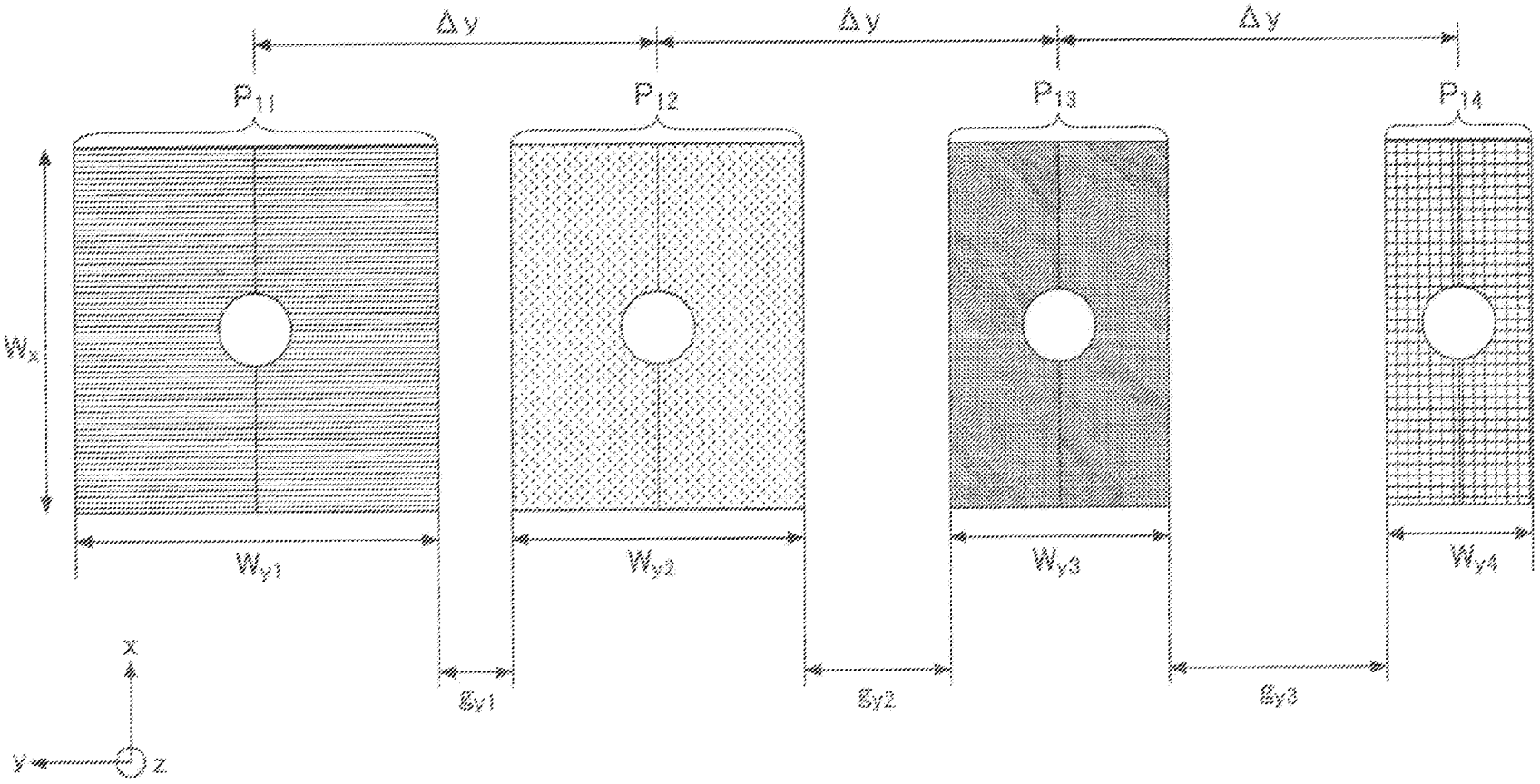
FIG. 29 is an enlarged plan view of another example of the reflectarray shown in FIG. 26.

In the structure shown in FIGS. 3 and 6, when a radio wave in which the electric field is directed to the x-axis direction comes from the infinity direction of the z-axis, the reflected wave travels in a transverse direction (the y-axis direction). The control of the reflected wave in this manner is referred to as "the horizontal control," for convenience. However, the present invention is not limited to the horizontal control. A radio wave in which the electric field is directed to the y-axis direction can be reflected in a longitudinal direction (the y-axis direction) by forming a reflectarray with the structure shown in FIG. 26, instead of the structure shown in FIGS. 3 and 6. The control of the reflected wave in this manner is referred to as "the vertical control," for convenience. In a case where the vertical control is to be performed, the sizes of the patches and the gaps may be determined by several methods. For example, as shown in FIG. 27, the distances Δy between the elements may be set to be common, and each of the patches may be set to be asymmetrical. Alternatively, as shown in FIG. 28, each of the patches may be set to be symmetrical, and the distances between the elements may be varied. Alternatively, as shown in FIG. 29, the distances Δy between the elements may be set to be common, and each of the patches may be set to be symmetrical. Theses are merely examples, and the sizes of the patches and the gaps may be determined by any suitable method.

2. Principle of the Multi-Beam Reflectarray

Figure 9:
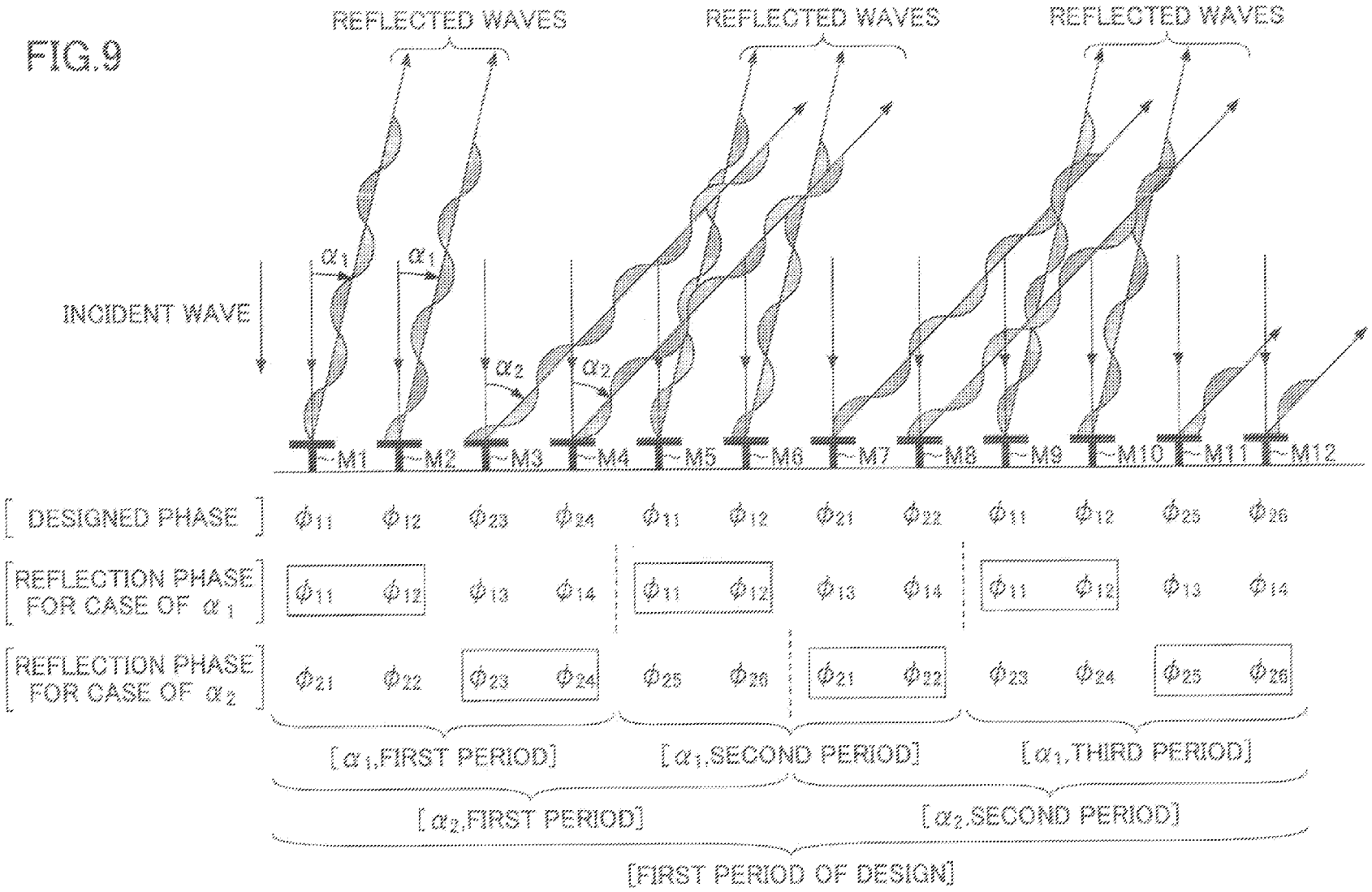
FIG. 9 is a diagram illustrating a multi-beam reflectarray.

FIG. 9 is a diagram illustrating a multi-beam reflectarray that reflects an incident radio wave in plural desired directions. The reflectarray shown in the figure includes at least 12 pieces (N pieces, in general) of elements from M1 to M12 which are arranged in the y-axis direction. In the reflectarray, structures, where each of the structures is similar to the 12 pieces (N pieces, in general) of elements, are arranged in the y-axis direction and in the x-axis direction repeatedly or periodically. In this regard, the structure of the multi-beam reflectarray is the same as the structure shown in FIG. 2. Hence, the plan view of the multi-beam reflectarray shown in FIG. 9 is substantially the same as that of FIG. 3. However, the structure of the multi-beam reflectarray is significantly different as to what types of reflection phases are to be achieved by designing each of the elements included in the multi-beam reflectarray.

Each of the elements is a component that reflects a radio wave. In the example shown in the figure, each of the elements is the mushroom-like structure. Alternatively, another structure may be used. Radio waves come from the infinity direction of the z-axis. The radio waves are reflected by the corresponding elements, thereby forming reflected waves. As described above, when $n_k$ pieces of elements achieve reflection phases such that a difference between the reflection phases of the corresponding neighboring elements is $\Delta\phi=360/n_k$ degrees, the radio waves are reflected with an angle of reflection $\alpha=\sin^{-1}[(\lambda\Delta\phi)/(2\pi\Delta y)]$. Here, k is the wavenumber and equals to $2\pi/\lambda$. The wavelength is denoted by λ. The difference between the neighboring elements is denoted by Δy. For example, when a phase difference between the neighboring elements $\Delta\phi_1$ $(=|\phi_{1i}-\phi_{1i+1}|)$ is 360/4=90 degrees for the reflection phases $\phi_{11}$, $\phi_{12}$, $\phi_{13}$, and $\phi_{14}$ of the corresponding four elements, the radio waves are reflected with an angle of reflection $\alpha_1=\sin^{-}[(\lambda\Delta\phi_1)/(2\pi\Delta y)]$.

Similarly, when a phase difference between the neighboring elements $\Delta\phi_2$ $(=|\phi_{2i}-\phi_{2i+1}|)$ is 360/6=60 degrees for the reflection phases $\phi_{21}$, $\phi_{22}$, $\phi_{23}$, $\phi_{24}$, $\phi_{25}$, and $\phi_{26}$ of the corresponding six elements, the radio waves are reflected with an angle of reflection $\alpha_1=\sin^{-1}[(\lambda\Delta\phi_2)/(2\pi\Delta\lambda)]$.

As indicated by "DESIGNED PHASE" in FIG. 9, reflection phases of the elements M1 and M2 are set to be values $\phi_{11}$ and $\phi_{12}$ which are related to a first angle of reflection $\alpha_1$. Reflection phases of the elements M3 and M4 are set to be values $\phi_{23}$ and $\phi_{24}$ which are related to a second angle of reflection $\alpha_2$. Reflection phases of the elements M5 and M6 are set to be the values $\phi_{11}$ and $\phi_{12}$ which are related to the first angle of reflection $\alpha_1$. Reflection phases of the elements M7 and M8 are set to be values $\phi_{21}$ and $\phi_{22}$ which are related to the second angle of reflection $\alpha_2$. Reflection phases of the elements M9 and M10 are set to be the values $\phi_{11}$ and $\phi_{12}$ which are related to the first angle of reflection $\alpha_1$. Reflection phases of the elements M11 and M12 are set to be values $\phi_{25}$ and $\phi_{26}$ which are related to the second angle of reflection $\alpha_2$. In the example shown in the figure, an element array formed of the 12 pieces of elements includes a first element group that reflects radio waves in a direction of the first reflection angle $\alpha_1$ and a second element group that reflects radio waves in a direction of the second reflection angle $\alpha_2$. Accordingly, when radio waves enter such an element array, a part of the radio waves is reflected in the direction of the first reflection angle $\alpha_1$ and another part of the radio waves is reflected in the direction of the second reflection angle $\alpha_2$. In this manner, there can be achieved the multi-beam reflectarray that reflects incident radio waves in the direction of the first reflection angle $\alpha_1$ and in the direction of the second reflection angle $\alpha_2$.

There is described later, as to whether the reflection phase of the each of the elements is adjusted to the first angle of reflection or the second angle of reflection.

In the example shown in the figure, it is assumed that the distance $\Delta y_1$ that is used for achieving the first angle of reflection $\alpha_1$ is equal to the distance $\Delta y_2$ that is used for achieving the second angle of reflection $\alpha_2$, namely $\Delta y_1=\Delta y_2=\Delta y$. It is not required that $\Delta y_1$ is equal to $\Delta y_2$. However, when this condition is satisfied, the angles of reflection and the numbers of the elements satisfy the following expressions.

$$\Delta\phi_1/\Delta\phi_2=\sin(\alpha_1)/\sin(\alpha_2)$$

$$\Delta\phi_1=2\pi/n_{k1}$$

$$\Delta\phi_2=2\pi/n_{k2}$$

Here, $\Delta\phi_1$ is a difference in reflection phases of the neighboring elements among the elements belonging to the first element group for achieving the first reflection angle $\alpha_1$. Similarly, $\Delta\phi_2$ is a difference in reflection phases of the neighboring elements among the elements belonging to the second element group for achieving the second reflection angle $\alpha_2$. The number of elements included in the first element group is represented by $n_{k1}$. The number of elements included in the second element group is represented by $n_{k2}$. When the above expressions are satisfied, one of the angles of reflection can be obtained from the other angle of reflection. For example, $\alpha_2=\sin^{-1}[n_{k1}\times\sin(\alpha_1)/n_{k2}]$.

As shown above, FIG. 9 shows an embodiment (embodiment A) in which beams are directed in two directions $\alpha_1$ and $\alpha_2$ by combining an array for the control angle $\alpha$1 which is formed of four elements such that a phase difference is 90 degrees and the phase rotates 360 degrees (2π radians) for one period and an array for the control angle $\alpha_2$ which is formed of six elements such that a phase difference is 60 degrees and the phase rotates 360 degrees (2π radians) for one period by arranging the elements while evenly spaced apart. Here, one period of the combined array is 12 elements, which is the least common multiple of the 6 elements and 4 elements (corresponding to three periods for $\alpha_1$ and two periods for $\alpha_2$).

The table shown in FIG. 10 indicates specific numerical examples of the number of elements $n_{k1}$ of the first element group, the number of elements $n_{k2}$ of the second element group, the first angle of reflection $\alpha_1$, the second angle of reflection $\alpha_2$, the phase difference $\Delta\phi_1$ for achieving $\alpha_1$, the phase difference $\Delta\phi_2$ for achieving $\alpha_2$, and the number of the elements included in one period of the combined array for the multi-beams of $\alpha_1$ and $\alpha_2$ (for the case where $\Delta y_1=\Delta y_2$).

In the above-described example, $\Delta y_1$ is equal to $\Delta y_2$. However, in general, it suffices if a rational multiple of the distance $\Delta y_1$ between the elements that are used for achieving the first angle of reflection $\alpha_1$ is equal to the distance $\Delta y_2$ between the elements that are used for achieving the second angle of reflection $\alpha_2$.

$$\Delta y_2=m_f\times\Delta y_1$$

Here, $m_f$ is a rational number. In this case, the first angle of reflection and the second angle of reflection satisfy the following expression.

$$\alpha_2=\sin^{-1}[m_f\times n_{k1}\times\sin(\alpha_1)/n_{k2}]$$

For convenience of the explanation, two types of the angles of reflection are considered. However, it is possible to design a multi-beam reflectarray that reflects radio waves in three or more desired directions ($\alpha_1, \ldots, \alpha_J$). Here, J is a natural number greater than or equal to 2. In this case, the element array includes the first element group for achieving the first angle of reflection $\alpha_1$, the second element group for achieving the second angle of reflection $\alpha_2, \ldots$, and a J-th element group for achieving a J-th angle of reflection $\alpha_J$. Here, it is not required that one element array (which corresponds to one sequence) includes all the J types of element groups. It suffices if the J types of element groups are included in accordance with some method of arrangement. This point is explained in the modified example.

3. Reflection Phases of Elements in the Multi-Beam Reflectarray

As explained by referring to FIG. 8, for designing a reflectarray, a graph (e.g., t24) is selected which corresponds to the thickness of the substrate that is used for designing, and subsequently each of sizes of plural aligned patches is determined depending on a reflection phase that is required at the position of the patch. Ideally, it is preferable that the patch sizes be designed, so that the change in the reflection phase by the whole of one element group which is aligned in the reflectarray is 360 degrees. However, as it can be found in the example shown in FIG. 8, it is possible that a reflection phase exists which is difficult to achieve because of theoretical and manufacturing reasons. For example, for the case of t16 (in the embodiment), there are no patch sizes Wx that can achieve a reflection phase greater than 144 degrees and a reflection phase smaller than 60 degrees. Even for the case of t24, it is difficult to achieve a reflection angle greater than 117 degrees, and a reflection angle smaller than −72 degrees. Additionally, since the distances between the elements Δx and Δy are 2.4 mm, when the size Wx of the patch is close to 2.4 mm, the gap (Δx−Wx) becomes extremely small, thereby making it difficult to manufacture. Thus, the reflectarray may be designed under the constraints of actually producible sizes of the patches and achievable reflection phases.

Additionally, the combined array for the multi-beams of $\alpha_1$ and $\alpha_2$ may not have a structure which is periodic per the least common multiple. For example, a structure (phase) selected for the first period may be different from a structure (phase) selected for the k-th period, where K is arbitrary.

Next, there is shown an embodiment (embodiment B) for a case where the combined array is formed in accordance with the combination No. 13 of FIG. 10, namely, the combined array is formed of an array in which one period is formed of 15 elements and an array in which one period is formed of 20 elements, where the period of the combined array is formed of 60 elements. In this case, as shown in the table, the corresponding phase differences are $\Delta\phi_1$=24 degrees and $\Delta\phi_2$=18 degrees.

The distances Δy and Δx between the neighboring elements are assumed to be 2.4 mm, respectively. Accordingly, the structure corresponding to one period has a length 2.4×60=144 mm. The reflection phases to be achieved by the corresponding 60 pieces of elements are determined as follows. First, among reflection phases that are required to realize specific angles of reflection, it is determined as to which reflection phases are achievable. Since the relation $\Delta\phi=k\times\Delta y\times\sin(\alpha)$ holds for the difference in the reflection phase Δφ and the angle of reflection α, a linear relationship holds between the reflection phase and coordinates (the positions of the elements arrange in the y-axis direction).

Figure 11:
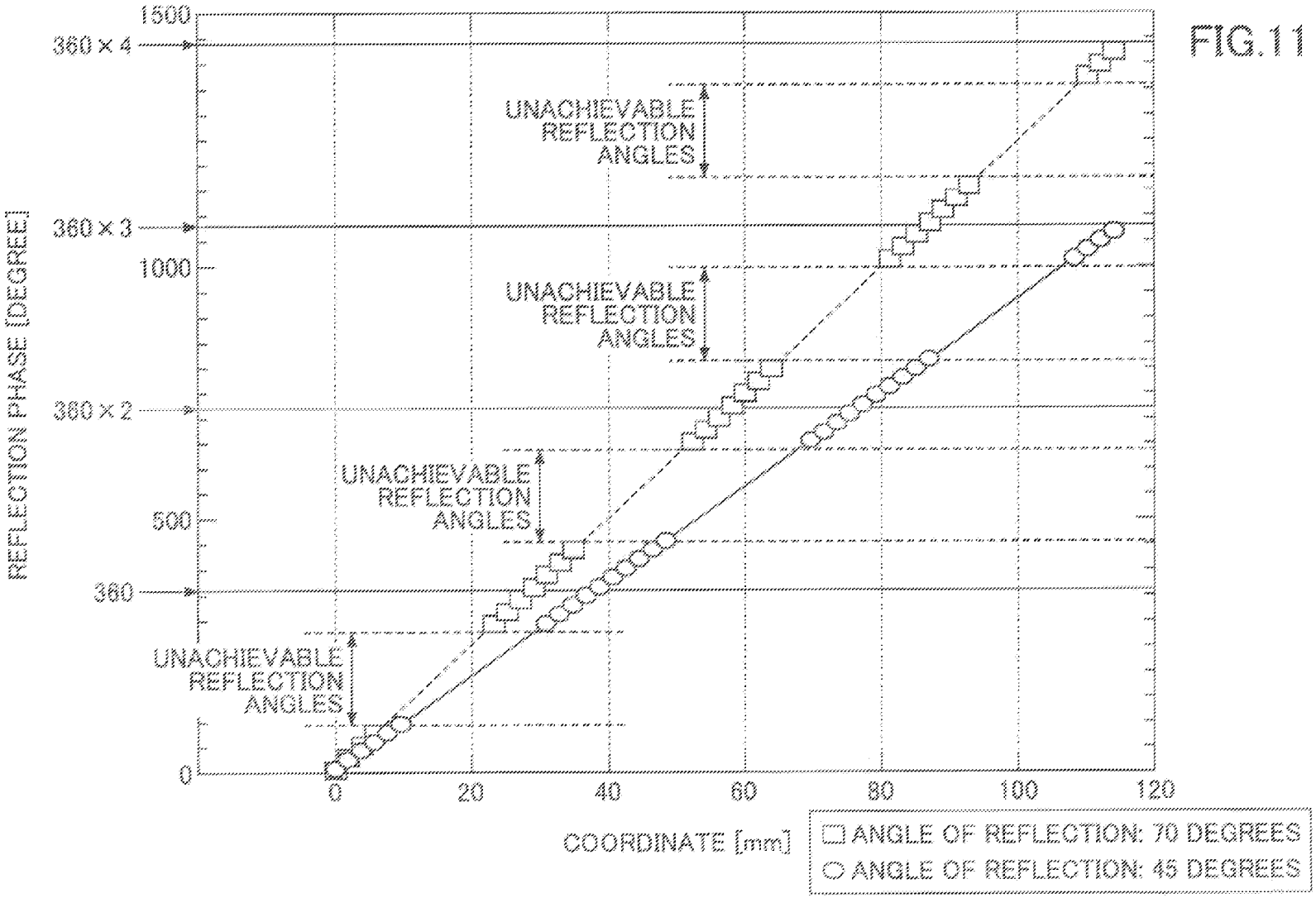
FIG. 11 is a diagram showing a relationship between the reflection phase and a coordinate.

FIG. 11 shows that, for each of the angle of reflection $\alpha_1$=70 degrees and the angle of reflection $\alpha_2$=45 degrees, such a linear relationship holds. (Here, based on the above expression, when the frequency f is 8.8 GHz, the angles of reflection $\alpha_1$ and $\alpha_2$ are 70 degrees and 45 degrees, respectively.) The horizontal axis is a coordinate (the y-axis), and the unit is mm. The elements are arranged along the y-axis, while being placed at every 2.4 mm. The vertical axis shows the reflection phase. The unit is degree, however the unit may be radian. The reflection phase is actually expressed in terms of an angle in the range of 360 degrees. However, for emphasizing the linear relationship, the straight lines are intentionally extended for angles greater than 360 degrees. In the figure, □ indicates that, at a coordinate position corresponding to that point, the reflection phase can actually be set so as to achieve the first angle of reflection $\alpha_1$=70 degrees. Similarly, ○ indicates that, at a coordinate position corresponding to that point, the reflection phase can actually be set so as to achieve the second angle of reflection $\alpha_2$=45 degrees. Further, when the thickness of the substrate is set to be a constant (e.g., 2.4 mm), it may not be possible to produce elements that achieve a reflection angle in a range from about 100 degrees to 290 degrees, due to the manufacturing and theoretical constraints that are shown by the graph. This is shown in the figure as ranges where □ or ○ are not indicated (unachievable reflection angles) in the straight lines. The unachievable reflection angles are determined by the manufacturing and theoretical constraints, and the unachievable reflection angles do not depend on an angle of reflection. Thus, the ranges of the unachievable reflection angles are the same for the first angle of reflection and for the second angle of reflection.

Figure 12:
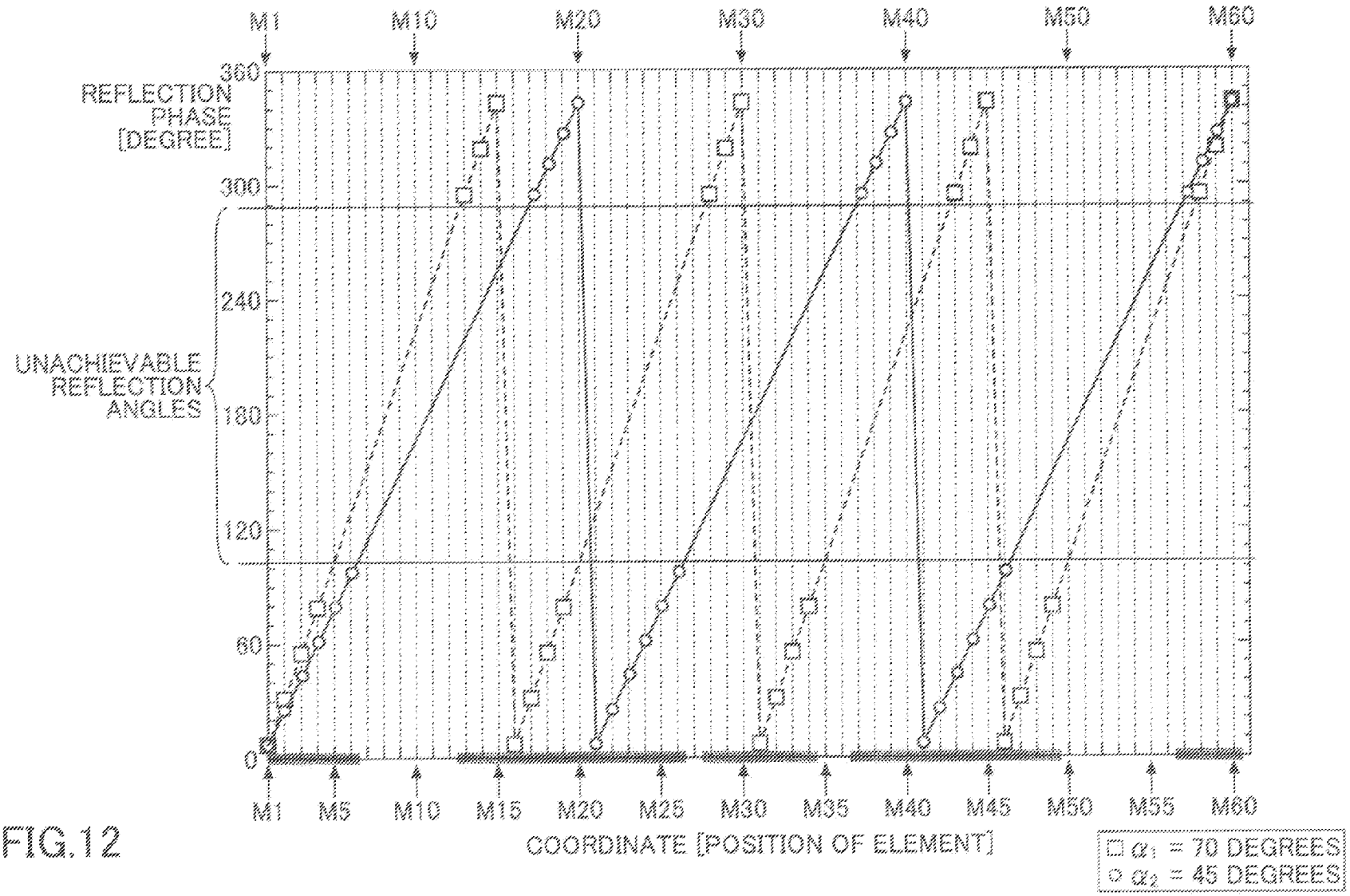
FIG. 12 is a diagram showing a relationship between the reflection phase which is converted in a range of 360 degrees and positions of the elements.

FIG. 12 shows a graph where the reflection phase in the graph of FIG. 11 is converted, so that the vertical axis is within a range of 360 degrees (the vertical axis=(the reflection phase) mod (360)). Further, the horizontal axis indicates the positions of the corresponding elements from M1 to M60, which are aligned in the y-axis direction. Reflection phases of the 44 pieces of elements M1-M6, M13-M26, M28-M34, M37-M49, and M57-M60 among these elements can be determined so as to achieve some angles of reflection. For the other elements, since there are no achievable reflection phases, theses elements may not contribute to any of the first reflected wave and the second reflected wave, in a case where these elements are left as they are. However, as explained in the modified example, the number of the elements that do not contribute to a desired reflected wave may be adjusted in a certain extent.

Reflection phases of the corresponding elements can be determined by the following method, for example.

[First Method]

Figure 13:
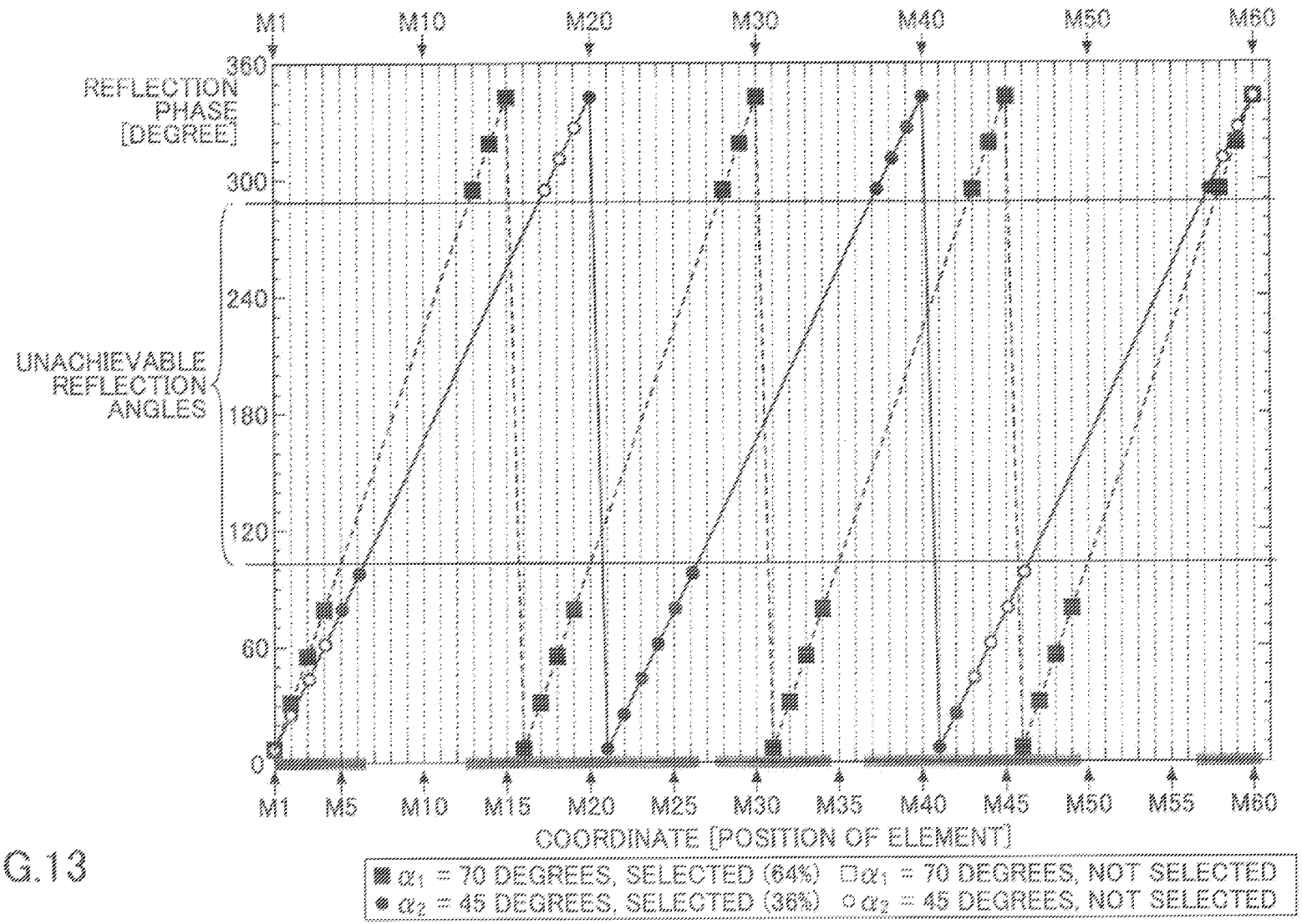
FIG. 13 is a diagram showing a state in which the reflection phases of the elements are selected, so that the reflected waves in 70 degrees are prioritized.
Figure 14:
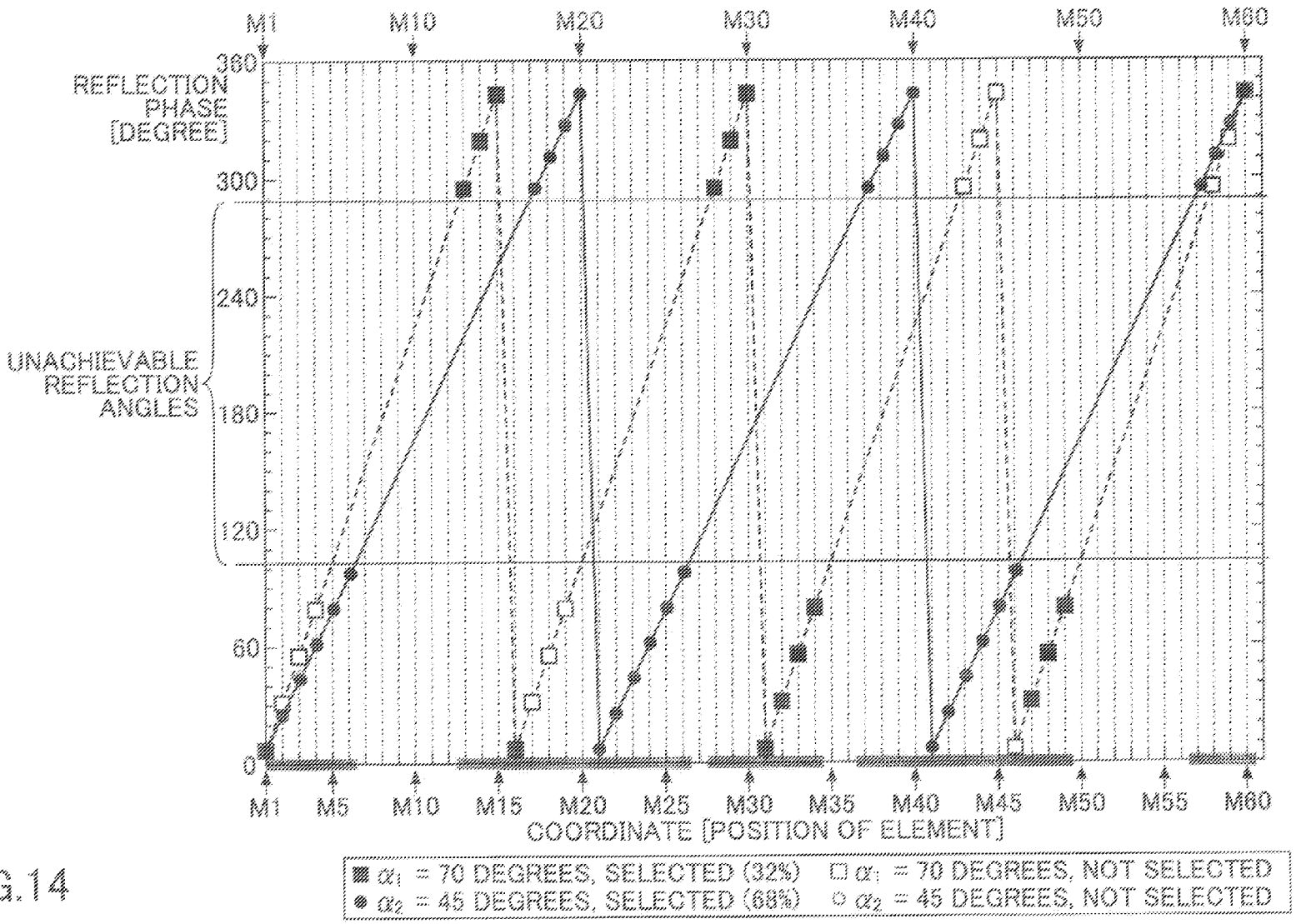
FIG. 14 is a diagram showing a state in which the reflection phases of the elements are selected, so that the reflected waves in 45 degrees are prioritized.

In one method of determining the reflection phases of the elements, one of a reflected wave forming the first angle of reflection and a reflected wave forming the second angle of reflection is attempted to be preferentially achieved. For example, suppose that the first angle of reflection $\alpha_1$=70 is attempted to be preferentially achieved. In this case, first, in the graph of FIG. 12, all the combinations of a reflection phase and a coordinate for achieving the first angle of reflection $\alpha_1$=70 (points indicated by □ on the straight line for $\alpha_1$=70 degrees) are selected. "Selecting a combination of a reflection phase $\phi$ and a coordinate Mx" means that the reflection phase of the element Mx is designed to be $\phi$. Next, if there exist any combinations of a reflection phase and a coordinate for achieving the second reflection angle $\alpha_2$ (points indicated by ○ on the straight line for $\alpha_2$=45 degrees) among the elements for which reflection phases are not determined, the combinations are selected. FIG. 13 shows the result of selecting the combinations of the reflection phase and the coordinate in this manner. As shown in the figure, 28 points (blackened squares) are selected as the points for the first angle of reflection $\alpha_1$=70 degrees, and 16 points (blackened circles) are selected as the points for the second angle of reflection $\alpha_2$=45 degrees. Since, among the 44 pieces of elements, 28 pieces (64%) are related to the first angle of reflection and 16 pieces (36%) are related to the second angle of reflection, the reflected wave of the first angle of reflection $\alpha_1$=70 degrees is prioritized. In this example, the first angle of reflection $\alpha_1$=70 degrees is preferentially determined. Conversely, the second angle of reflection $\alpha_2$=45 degrees may be preferentially determined. Namely, first, all the combinations of a reflection phase and a coordinate for achieving the second reflection angle $\alpha_2$=45 degrees (the points indicated by ○ on the straight line for $\alpha_2$) are selected. Next, if there exist any combinations of a reflection phase and a coordinate for achieving the first reflection angle $\alpha_1$ (points indicated by □ on the straight line for $\alpha_1$) among the elements for which reflection phases are not determined, the combinations are selected. The result of selecting in this manner is shown in FIG. 14. As shown in the figure, 14 points are selected as the points for the first angle of reflection $\alpha_1$=70 degrees, and 30 points are selected as the points for the second angle of reflection $\alpha_2$=45 degrees. Since, among the 44 pieces of elements, 14 pieces (32%) are related to the first angle of reflection and 30 pieces (68%) are related to the second angle of reflection, the reflected wave of the second angle of reflection $\alpha_2$=45 degrees is prioritized.

[Second Method]

Figure 15:
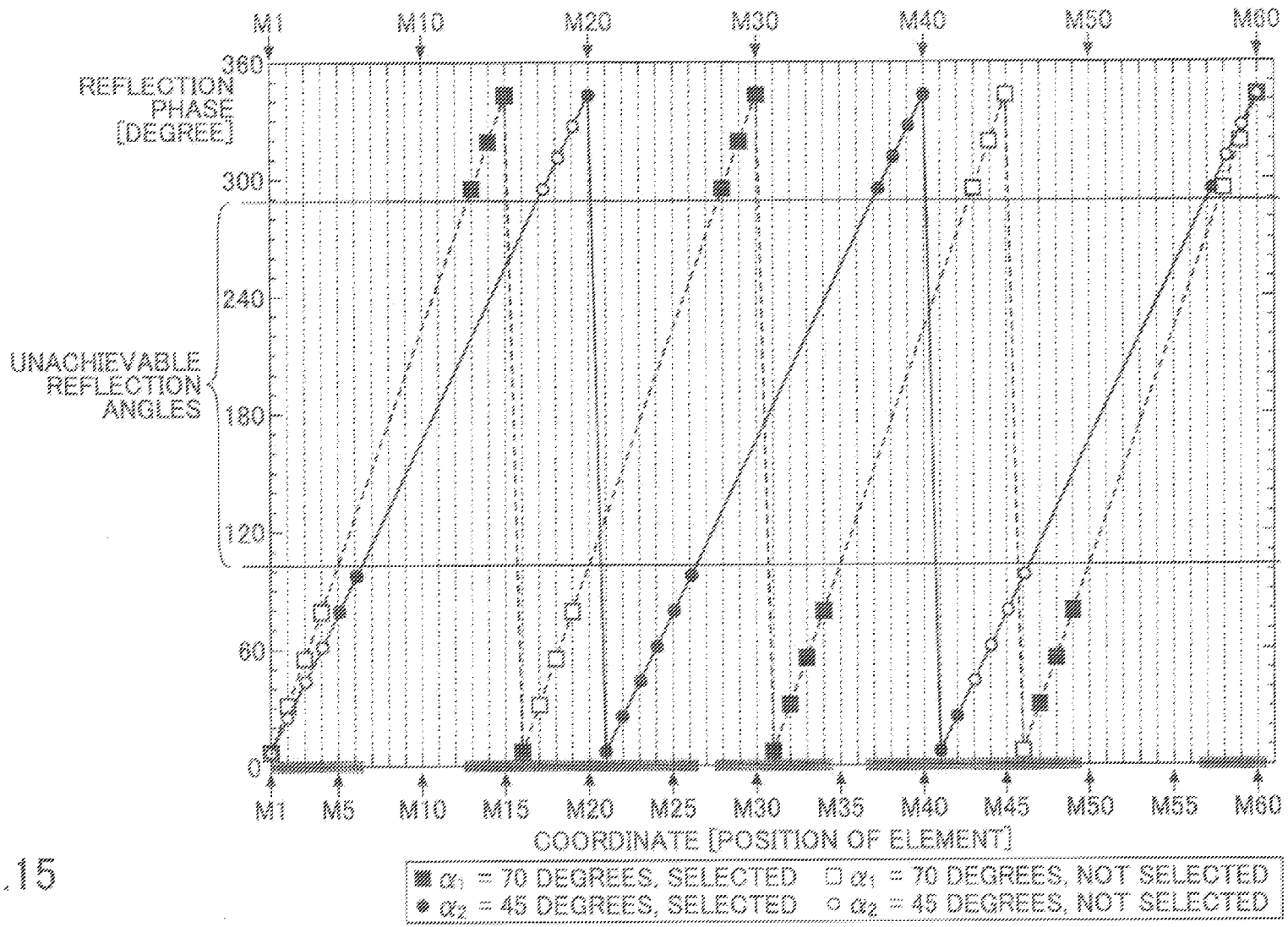
FIG. 15 is a diagram showing a state where two choices of the reflection phases exist for a single element.

In another method of determining the reflection phases of the elements, relative relations among the elements are considered. First, for each of elements for which there is only one achievable reflection phase, that reflection phase is selected. FIG. 15 shows a state immediately after the reflection phases are determined in this manner. Specifically, for M13-M16, M28-M34, and M47-M49, the reflection phases for achieving the first angle of reflection $\alpha_1$=70 degrees are assigned. For M5, M6, M20-M26, M37-M42, and M57, the reflection phases for achieving the second angle of reflection $\alpha_2$=45 degrees are assigned. For M1-M4, M17-M19, M43-M46, and M58-M60, any one of the first angle of reflection and the second angle of reflection is achievable. The decision as to which angle of reflection is to be selected may be determined at least based on the following three viewpoints. However, the decision may be made from another point of view. In general, the reflected wave forming the first angle of reflection becomes stronger as the more elements for achieving the first angle of reflection are selected. Conversely, the reflected wave forming the second angle of reflection becomes stronger as the more elements for achieving the second angle of reflection are selected.

One method that can be used for determining reflection phases for the elements M1-M4 is "making plural pieces of elements achieve the same reflection phase." A reflected wave corresponding to the reflection phase can more surely formed for a case where there are plural pieces of elements that achieve the reflection phase corresponding to a specific value, compared to a case where there is only one element that achieves the reflection phase corresponding to the specific value. For example, as shown in FIG. 15, supposed that the reflection phases of a portion of the elements are uniquely determined. In this case, there are no elements that achieve the same reflection phase as that of the element M23, and there are no elements that achieve the same reflection phase as that of the element M24. Thus, the reflection phases for achieving the second reflection angle $\alpha_2$=45 degrees are assigned to M3 and M4, respectively. The reflection phases for M1 and M2 may not be determined by the determination basis of "making plural pieces of elements achieve the same reflection phase." In this case, the reflection phases may be determined, so that "the neighboring elements achieve the same angle of reflection, as much as possible." That is because, when plural elements for a specific angle of reflection are continuously arranged, reflection phases of the reflected waves from the corresponding elements also continuously vary, thereby facilitating to achieve the specific angle of reflection. Based on these viewpoints, the reflection phases of continuously arranged M1-M6 are set to be the corresponding reflection phases for achieving the second reflection angle $\alpha_2$=45 degrees.

For the elements M17-M19, the reflection phases can be determined by the viewpoint of "making plural pieces of elements achieve the same reflection phase." Specifically, in FIG. 15, there are no elements that achieve the same reflection phase as that of the element M38, and there are no elements that achieve the same reflection phase as that of the element M39. Thus, the reflection phases for achieving the second reflection angle $\alpha_2$=45 degrees are assigned to the elements M18 and M19, respectively. From the view point that "the neighboring elements achieve the same angle of reflection as much as possible," the reflection phase for achieving the second angle of reflection $\alpha_2$=45 degrees is assigned to the element M17. In this manner, the reflection phases for realizing the second angle of reflection $\alpha_2$=45 degrees are assigned to the elements M17-M19.

Reflection phases for the elements M43-M46 can be determined by a viewpoint of "considering quantitative balance of the number of the elements." Considering the number of the determined elements among the elements M1-M42, there are only 11 pieces of the elements for achieving the first angle of reflection $\alpha_1$=70 degrees, and the proportion of these elements is small. It suffices, if the second angle of reflection $\alpha_2$ is to be prioritized. However, from a viewpoint of ensuring a certain level of the intensity of the reflected wave forming the angle of reflection $\alpha_1$, the reflection phases for achieving the first angle of reflection $\alpha_1$=70 degrees are assigned to the corresponding elements M43-M46.

Reflection phases for the elements M58-M60 can be determined by the viewpoint that "the neighboring elements achieve the same angle of reflection, as much as possible."

Namely, the reflection phases of M58-M60 are set to the reflection phases for achieving the second angle of reflection $\alpha_2$=45 degrees, and the reflection phases of the continuously arranged M57-M60 are set to be the reflection phases for achieving the second angle of reflection $\alpha_2$=45 degrees.

Figure 16:
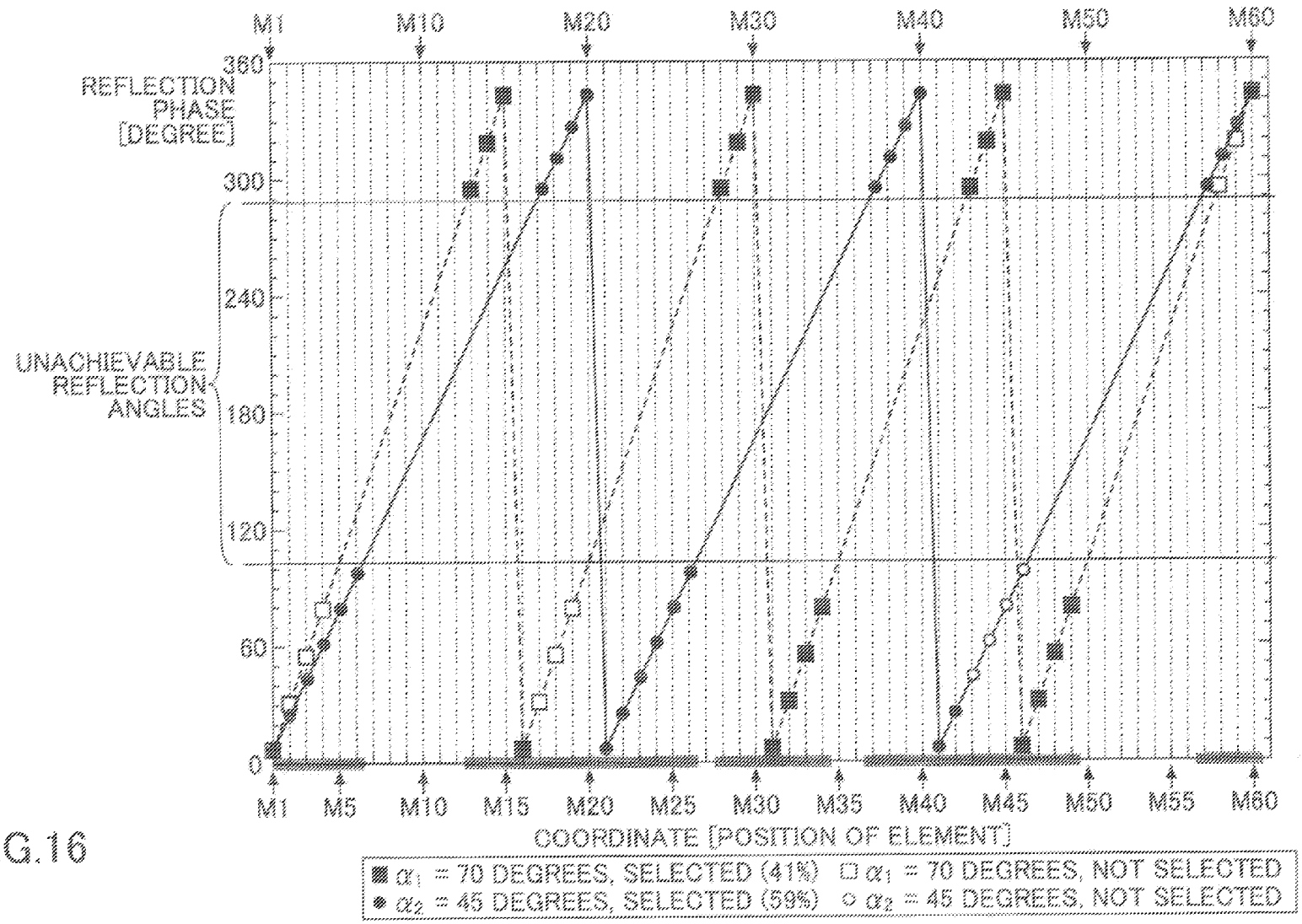
FIG. 16 is a diagram showing a state where the reflection phases of the elements are selected from another point of view.

FIG. 16 shows the result of determining the reflection phases in this manner. In the example shown in FIG. 16, 18 points (41%) are selected for the first angle of reflection $\alpha_1$=70 degrees, and 26 points (59%) are selected for the second angle of reflection $\alpha_2$=45 degrees. The second angle of reflection $\alpha_2$=45 degrees is prioritized. Such quantitative proportion of the number of the elements is between the example shown in FIG. 13 and the example shown in FIG. 14. Namely, the number of the elements for 70 degrees: the number of the elements for 45 degrees for the example of FIG. 13 (the case where the angle 70 degrees is prioritized), for the example of FIG. 16, and for the example of FIG. 14 (the case where the angle 45 degrees is prioritized) are 28:16, 18:26, and 14:30, respectively. Since, among the 60 pieces of elements, the number of the elements for which the reflection phases can be determined by using the graph shown in FIG. 12 is 44 pieces, when the number of the elements are represented by the percentage (%), these become 64:36, 41:59, and 32:68, respectively. Further, as it can be found from the comparative example of the proportion of the number of elements for FIGS. 13, 14, and 16, the reflection phases for the corresponding elements may be determined, so that the ratio between the number of the elements for the angle of 70 degrees and the number of the elements for the angle of 45 degrees becomes a predetermined value. The above-described methods for determining the reflection phases are merely specific examples. The reflection phases may be determined by another point of view. Further, for determining the reflection phases for the corresponding elements having plural choices, the reflection phases are determined in the ascending order of the reference numbers of the elements. However, the reflection phases may be determined in another order.

[Third Method]

For the cases of the first method and the second method, the reflection phases of the corresponding elements are set to be some values whenever some reflection phases can be realized at the positions of the corresponding elements, thereby making as many elements as possible contribute to some reflected waves. Accordingly, in the cases of the examples shown in FIGS. 13, 14, and 16, as shown by the marks of ● and ■, the reflection phases of 44 pieces of the elements among 60 pieces of the elements are set to be some corresponding values.

However, in these cases, it is possible that undesired reflected waves and interferences are generated besides the desired reflected waves. For the case of the example shown in FIG. 16, the element M24 has a reflection phase of approximately 60 degrees, and it is intended to contribute to the reflected wave of the second angle of reflection $\alpha_2$=45 degrees. It is the element M4 that contributes to the second angle of reflection and that has the reflection phase similar to that of the element M24. The elements in the vicinity of M24 and the elements in the vicinity of M4 contribute to the second angle of reflection $\alpha_2$. For the case of the example shown in FIG. 16, the element M33 which is placed at a position closer to the element M24 than that of the element M4 also has the reflection phase of approximately 60 degrees. However, the element M33 is intended to contribute to the first angle of reflection $\alpha_1$. Namely, the elements in the vicinity of M24 which are to be contributing to the first angle of reflection $\alpha_1$ and the elements in the vicinity of M33 which are to be contributing to the second angle of reflection $\alpha_2$ are relatively close to each other. Hence, it is possible that these elements interfere with each other.

The third method addresses such a disadvantage. Specifically, as shown in the left side of FIG. 30, first, the reflection phases in a range from 0 degrees to 360 degrees are divided into two ranges (for a case where three or more angles of reflection are intended, the range of the reflection phase is divided into three ranges). For the case of the example shown in the figure, the reflection phases are divided into a first range R1 from 0 degrees to 180 degrees and a second range R2 from 180 degrees to 360 degrees. Next, reflection phases of the corresponding elements are determined, so that the reflection phases belonging to the first range R1 contribute to the first angle of reflection $\alpha_1$=70 degrees. Similarly, reflection phases of the corresponding elements are determined, so that the reflection phases belonging to the second range R2 contribute to the second angle of reflection $\alpha_2$=45 degrees. Here, as the elements M17-M19, when both the reflection phases belonging the first range R1 and the second range R2 can be assigned, one of the ranges is selected. Any method that is explained in the first method or the second method may be used as to which one is to be selected.

Figure 30:
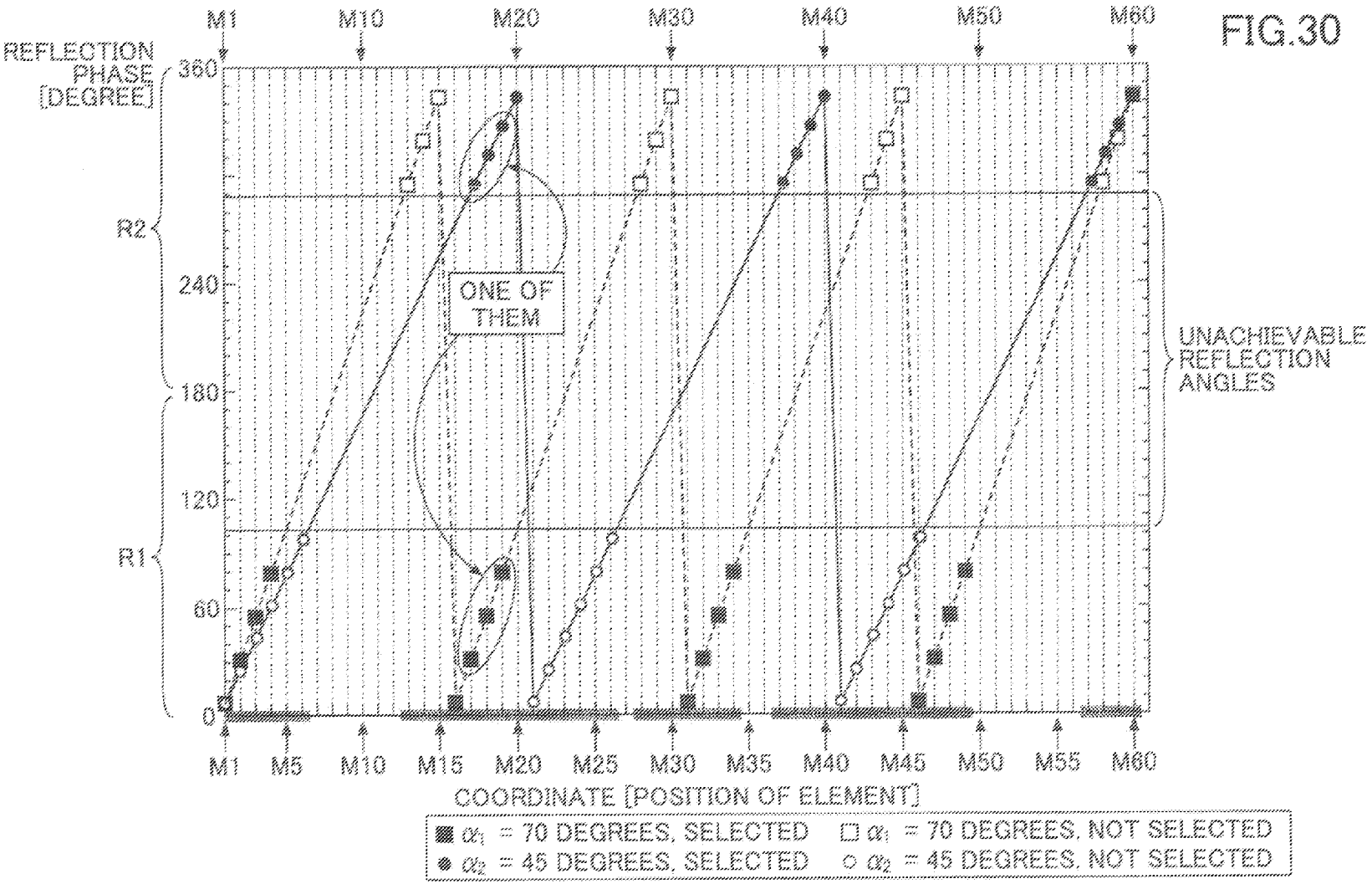
FIG. 30 is a diagram showing a state where the reflection phases of the elements have been selected by considering a range of the reflection phases.

FIG. 30 shows an example where the reflection phases of the corresponding elements are determined by such a viewpoint. As shown in the figure, the reflection phases belonging to the first range R1 are determined so as to achieve the first angle of reflection $\alpha_1$=70 degrees. In this case, the elements for the same reflection phase are arranged while being almost evenly spaced apart. Further, the reflection phases belonging to the second range R2 are determined so as to achieve the second angle of reflection $\alpha_2$=45 degrees. In this case, the elements for the same reflection phase are arranged while being almost evenly spaced apart. By determining the reflection phases of the corresponding elements in this manner, the above-described disadvantageous interferences can be effectively suppressed. For the case of the example shown in FIG. 30, no reflection phases are assigned to 19 pieces of the elements (M5, M6, M13-M15, M21-M26, M28-M30, and M41-M45), though there exist achievable reflection phases. Accordingly, the number of the elements (25 pieces) of which the reflection phases are set to be some values is smaller than the cases of FIGS. 13, 14, and 16 (44 pieces). However, this case is advantageous from the point of view that undesired interferences and unnecessary reflected waves can be suppressed.

4. Simulation

Figure 17:
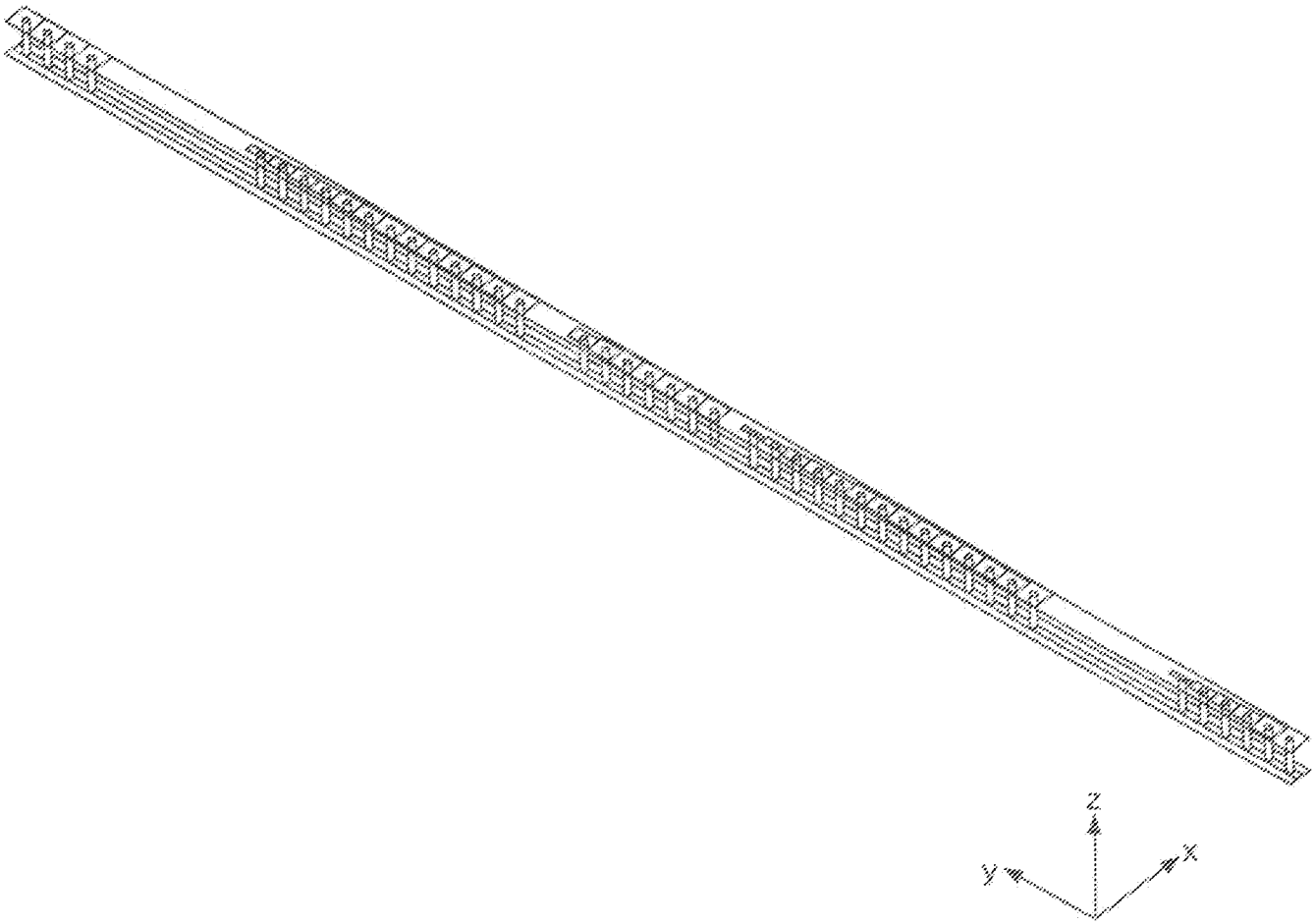
FIG. 17 is a perspective view of an analytical model that is used in a simulation.
Figure 18:
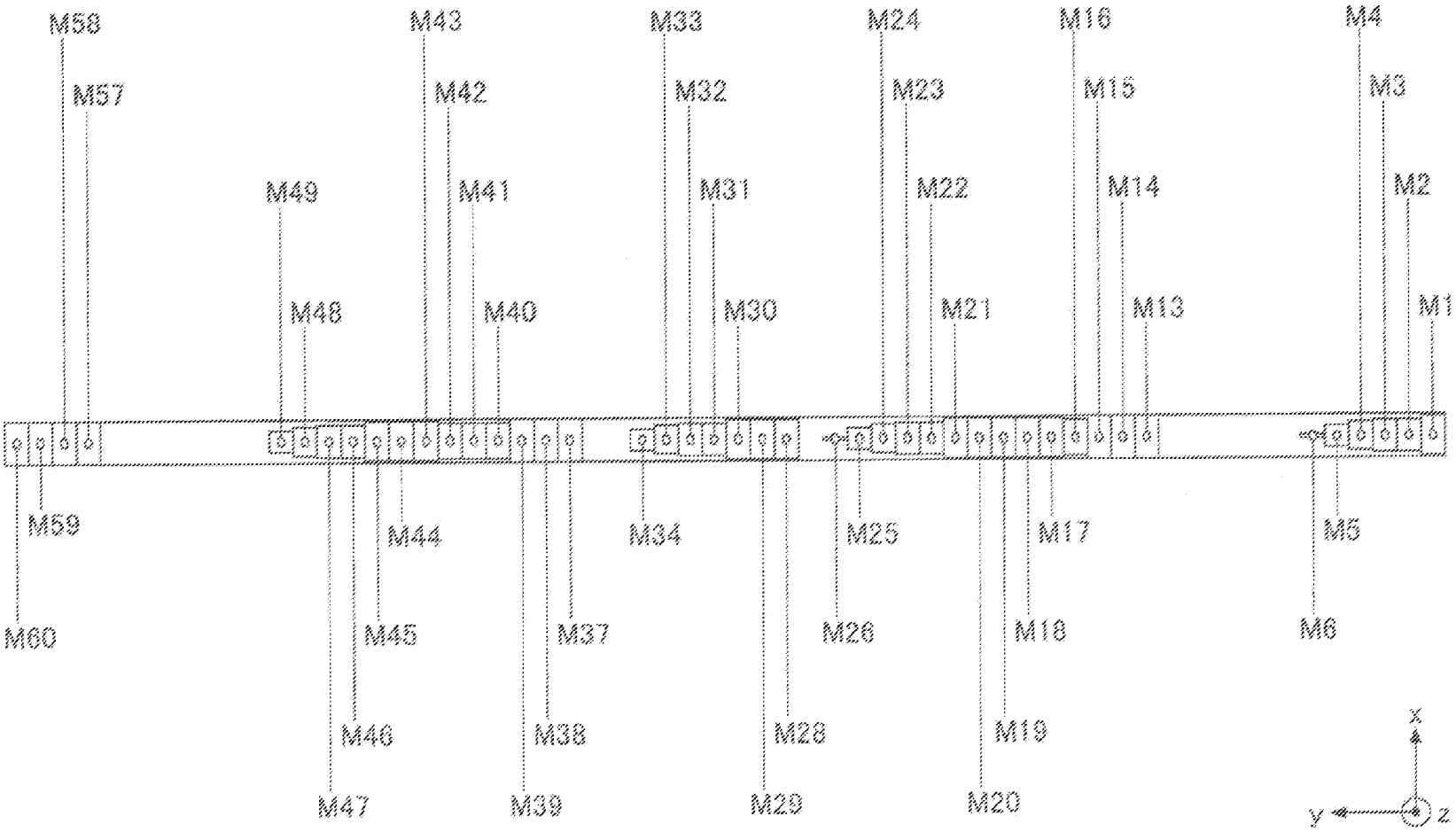
FIG. 18 is a plan view of the analytical model.
Figure 19:
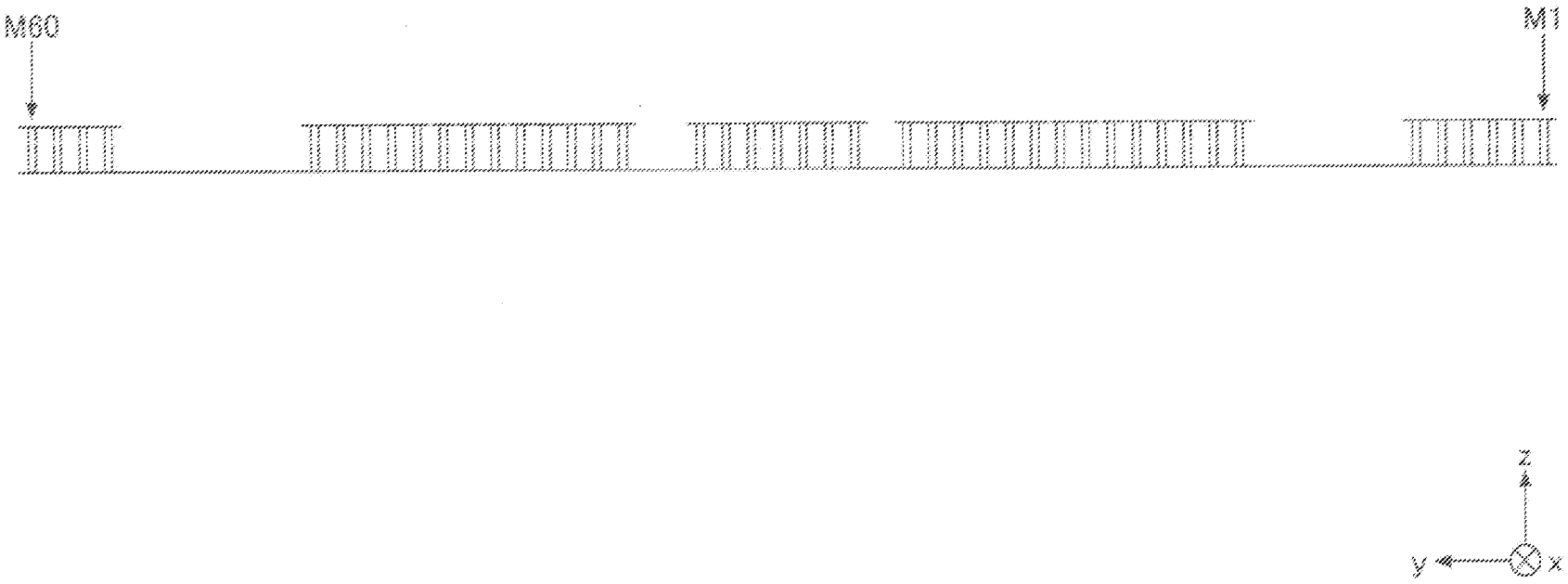
FIG. 19 is a side view of the analytical model.

There is explained a result of simulation regarding the multi-beam reflectarray. FIG. 17 is a perspective view of an analytical model that is used for the simulation. FIG. 18 shows a plan view of the analytical model shown in FIG. 17, where M1-M60 are aligned along the y-axis direction. There are omitted the elements placed at positions where reflection angles are not achieved. Ideally, there would be 60 elements. However, there are shown 44 pieces of the elements that can actually achieve reflection angles among them. FIG. 19 shows a side view of the analytical model shown in FIG. 17. Radio waves come from the infinity direction of the z-axis direction, and the radio waves reflect in the yz-plane. The analytical model shown in FIGS. 17-19 represents one periodic structure forming the multi-beam reflectarray. In the actual multi-beam reflectarray, one or more such periodic structures are repeatedly arranged in the x-axis direction and in the y-axis direction.

Figure 20:
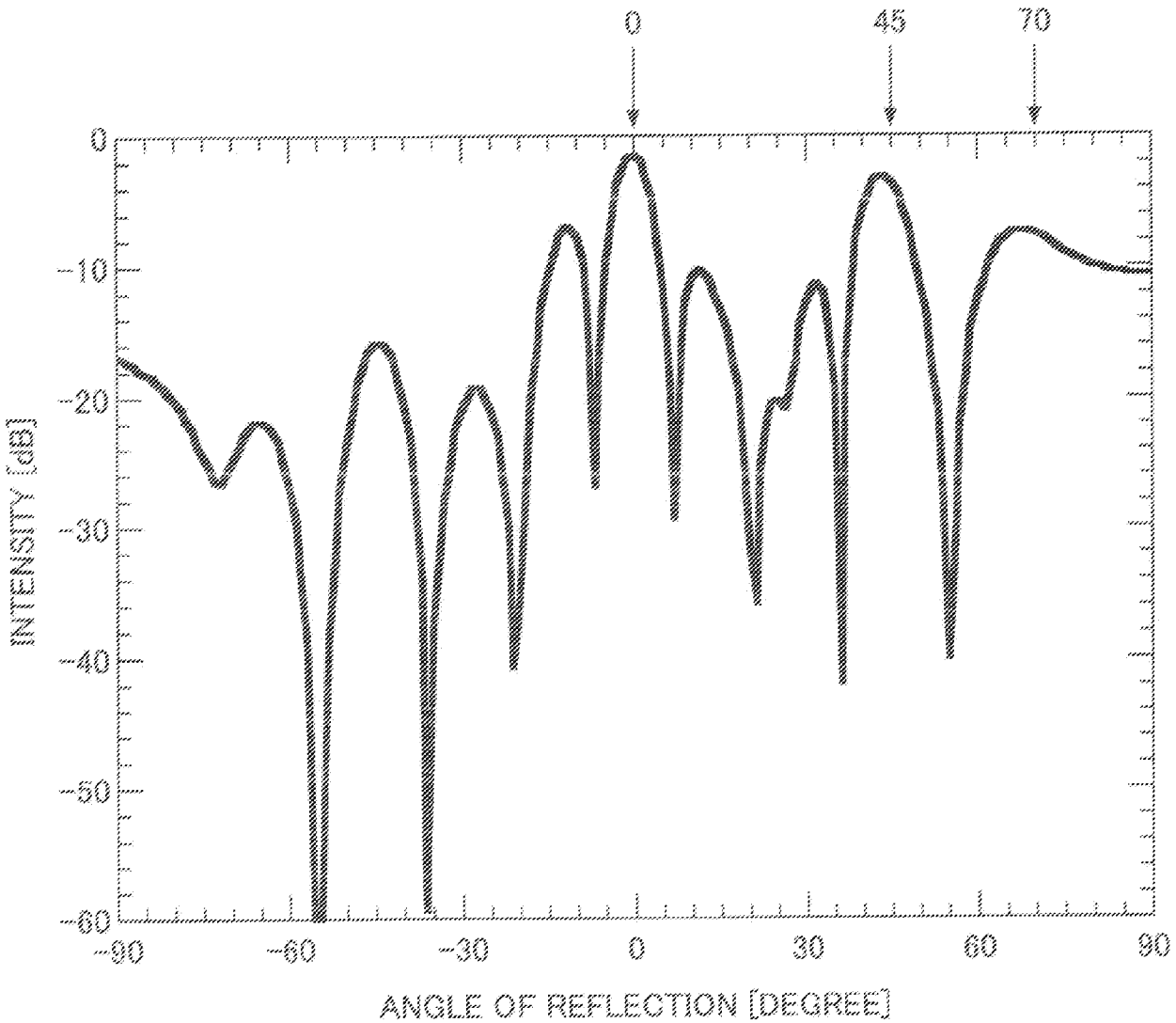
FIG. 20 is a diagram showing a far radiation field of the reflected wave.

FIG. 20 shows far radiation fields of the reflected waves, where intensities of the reflected waves with respect to angles of reflection are shown. In the simulation, the first angle of reflection $\alpha_1$ is set to be 70 degrees and the second angle of reflection $\alpha_2$ is set to be 45 degrees. As shown in the figure, strong reflected waves (beams) occur in directions of 70 degrees and 45 degrees. A strong beam also occurs in a direction of 0 degrees. This shows an effect of specular reflection due to a bottom board, for example.

Figure 21:
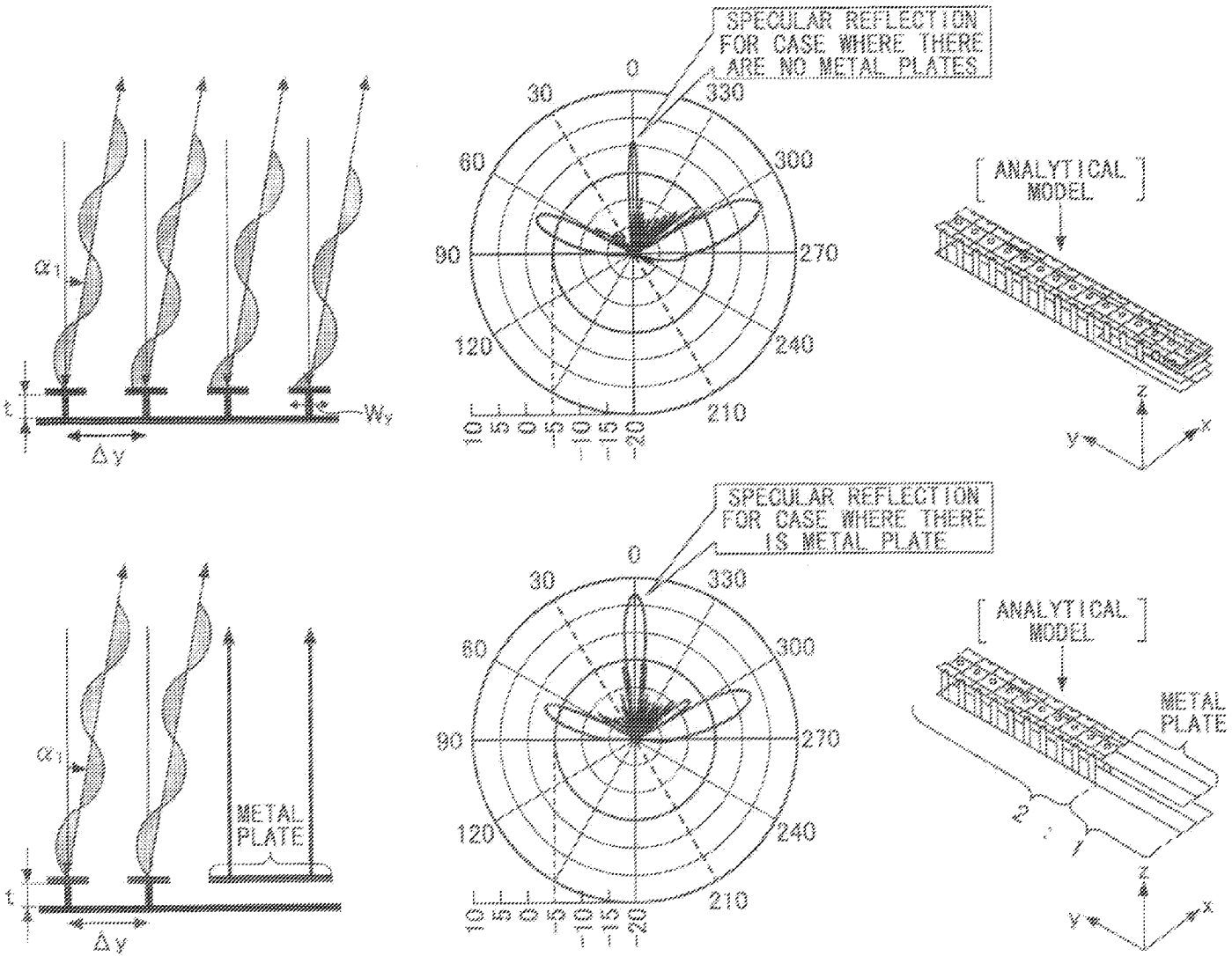
FIG. 21 is a diagram showing a comparative example between a case where a metal plate is used and a case where the metal plate is not used.

Next, there is considered a relationship between an intensity of a reflected wave forming a desired reflected angle and the number of the elements. In a case where a first angle of reflection $\alpha_1$ is set to be 70 degrees, a second angle of reflection $\alpha_2$ is set to be 0 degrees, and a third angle of reflection $\alpha_3$ is set to be −70 degrees, a reflected wave forming the second angle of reflection $\alpha_2$=0 degrees occurs without intentionally designing it. This is because the specular reflection occurs due to the effect of the bottom board, for example. Accordingly, even if reflection phases of all the elements are adjusted for the first angle of reflection $\alpha_1$=70 degrees or the third angle of reflection $\alpha_3$=−70 degrees, a specular reflected wave having a certain intensity occurs (the upper half in FIG. 21). However, it may be considered to secure a portion of the elements for the specular reflection. For example, this can be achieved by replacing a part of the elements arranged in the y-axis direction with simple metal plates. As shown in the analytical model in the lower right of FIG. 21, suppose that reflection phases of two third of all the elements are set for the first angle of reflection $\alpha_1$=70 degrees or for the third angle of reflection $\alpha_3$=−70 degrees, and the elements corresponding to the remaining one third are replaced with the metal plates. Referring to the two intensity graphs of the reflected waves shown in the polar coordinate systems in the upper and lower portions of FIG. 21, it can be found that, the specular reflected waves are at an extent of only 0 dB when the metal plates are not installed, and the specular reflected waves become so strong that their intensity reaches 7 dB when the metal plates are installed. When the metal plates are installed, the reflected waves for the first angle of reflection $\alpha_1$=70 degrees and the third angle of reflection $\alpha_3$=−70 degrees are slightly weakened due to the increase in the intensity of the specular reflection. In this manner, by intentionally installing the metal plate, the intensity of the specular reflection (that is, the reflected waves for the second angle of reflection $\alpha_2$=0 degrees) can be intensified. Disposing the metal plates in one third of the area corresponds to increasing the elements for achieving the reflected phases for the second angle of reflection $\alpha_2$=0 degrees. Accordingly, by adjusting the number of elements for achieving the second angle of reflection, the strength of the reflected waves forming the second angle of reflection can be adjusted.

Figure 31:
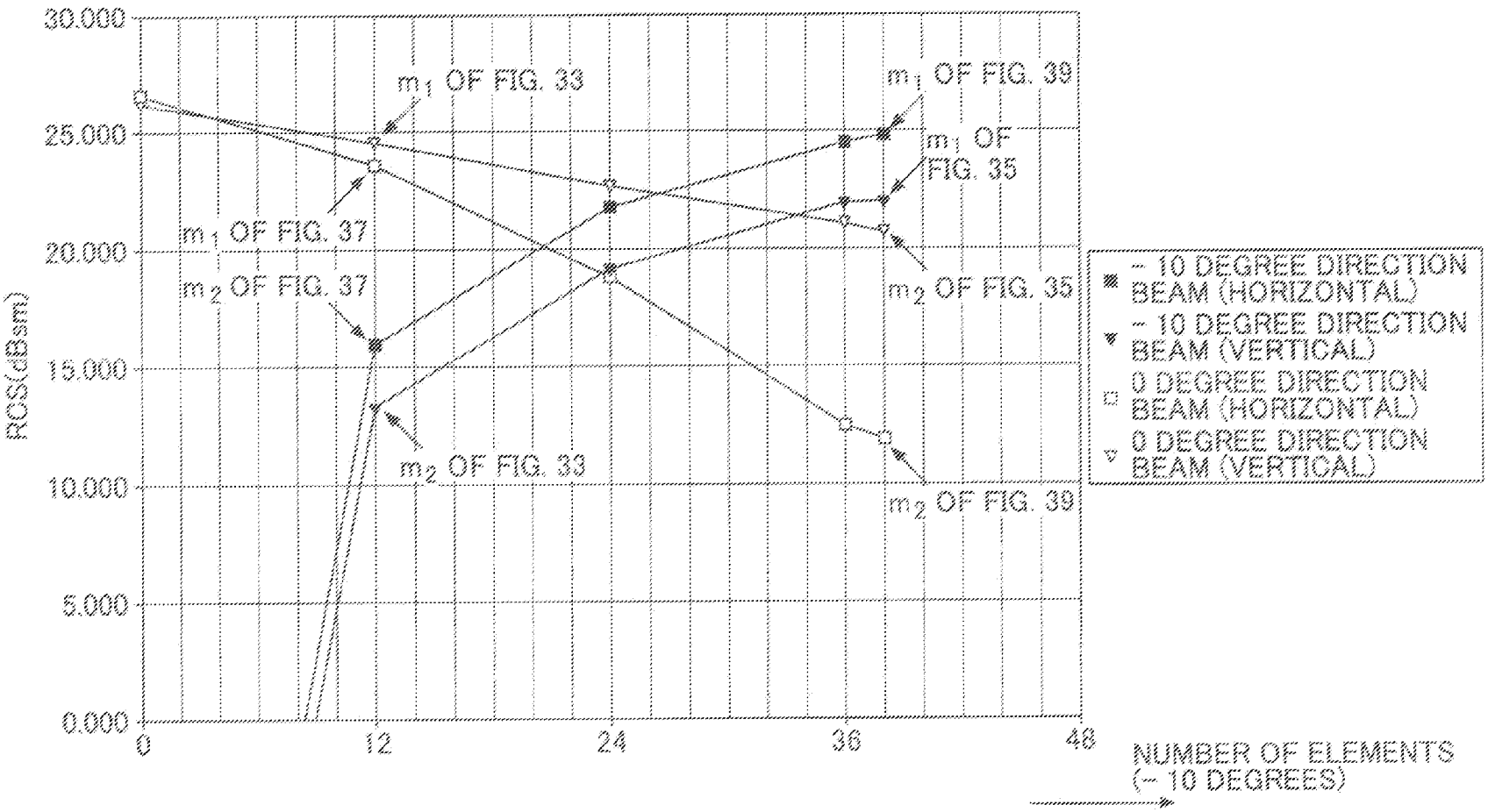
FIG. 31 is a diagram showing a relationship between a number of elements which have been adjusted to a specific angle of reflection and the reflected waves.

The result of the simulation shown in FIG. 31 represents a relationship among radio waves (reflected waves) reflected in a direction of a first reflected angle $\alpha_1$=−10 degrees, radio waves (reflected waves) reflected in the direction of the second angle of reflection $\alpha_2$=0 degrees, and a number of elements $n_{\alpha1}$ that contribute to the first angle of reflection. The frequency of the radio waves is 11 GHz, and the size of the reflector is approximately 470 mm×350 mm. It is assumed that the horizontal axis represents, among 70 pieces of the elements, the number $n_{\alpha1}$ of elements that are designed to contribute to the first angle of reflection $\alpha_1$=10 degrees, and the remaining elements are designed to contribute to the second angle of reflection $\alpha_2$=0 degrees ($n_{\alpha2}$=70−$n_{\alpha1}$). The vertical axis shows corresponding scattering cross sections of the reflected waves in the first and second angles of reflection. The simulation is performed for both the horizontal control and the vertical control.

Figure 32:
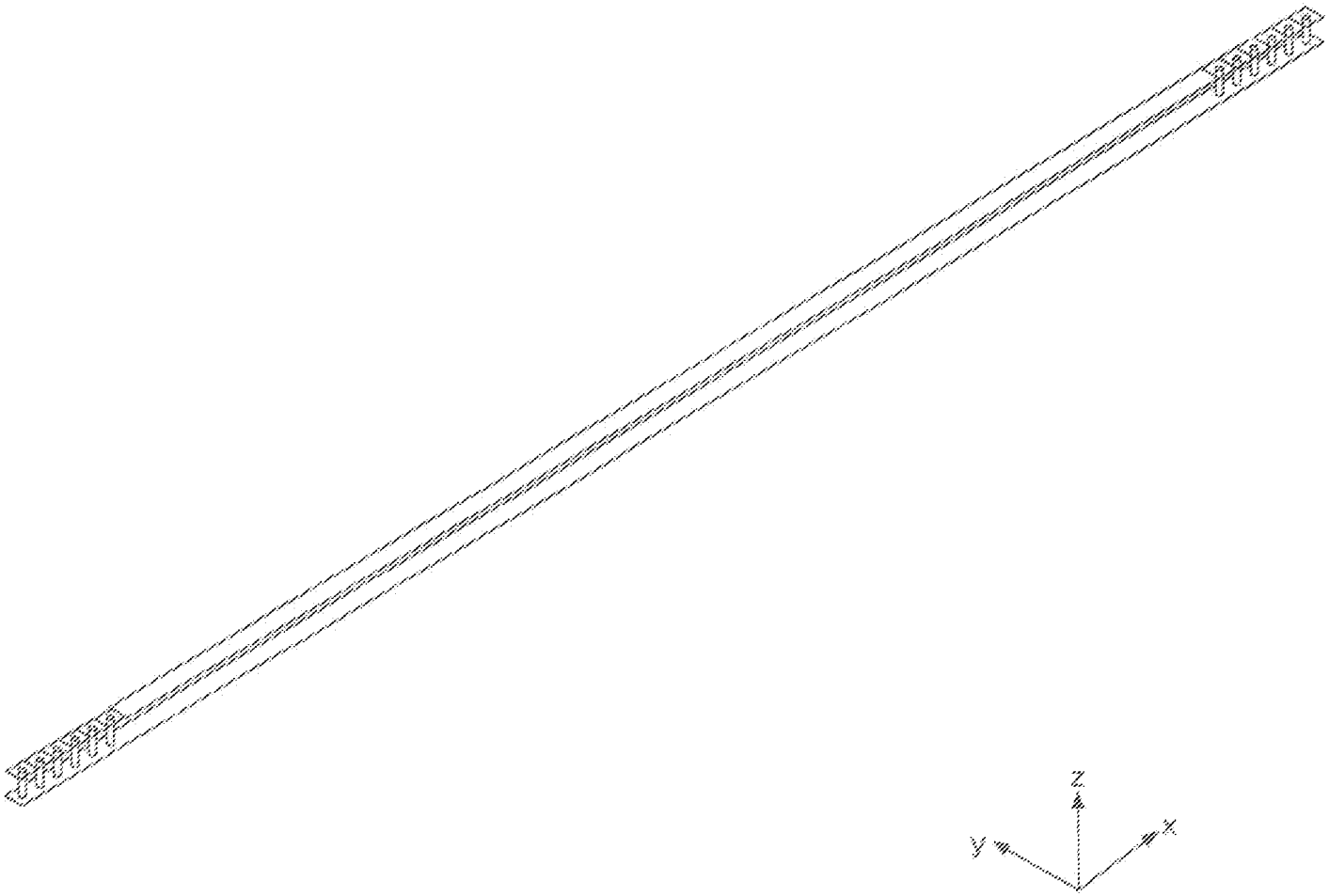
FIG. 32 is a perspective view of the analytical model that is used in a simulation (H10, metal plates 58, elements 12)
Figure 33:
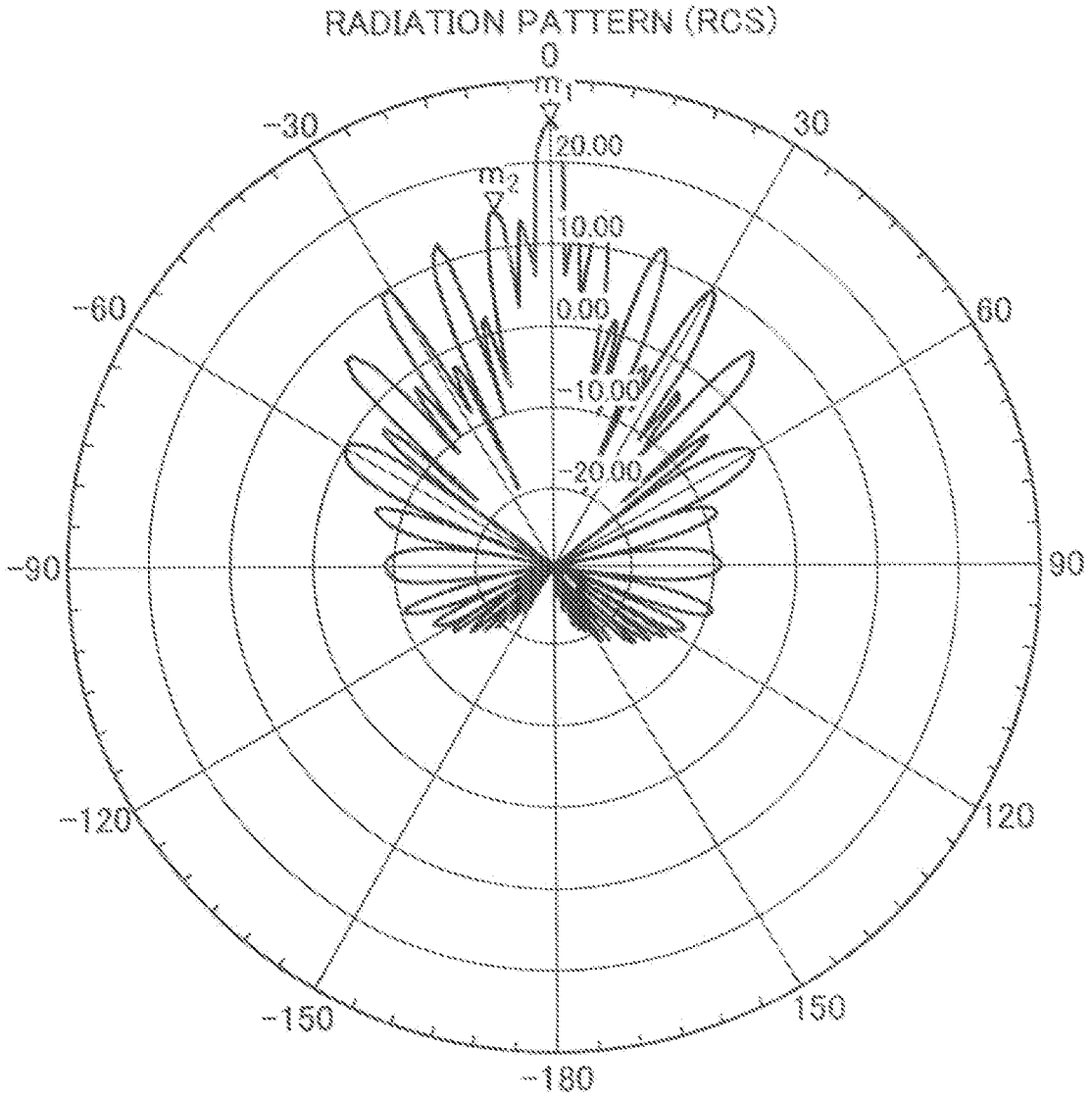
FIG. 33 is a diagram showing a result of the simulation (H10, metal plates 58, elements 12)

FIG. 32 shows a simulation model, where radio waves are reflected from $n_{\alpha1}$=12 pieces of the elements and from $n_{\alpha2}$=70−12=58 pieces of the elements in the horizontal control. The sizes of the elements that contribute to the first angle of reflection $\alpha_1$=−10 degrees are defined, so that the reflection phases of the elements correspond to their positions. All the elements that contribute to the second angle of reflection $\alpha_2$=0 degrees are achieved by a metal plate. FIG. 33 shows a result of the simulation that has been performed by using the model shown in FIG. 32. In the figure, the largest reflected wave m1 occurs in the direction of the second angle of reflection $\alpha_2$=0 degrees, and the strong reflected wave m2 occurs in the direction of the first angle of reflection $\alpha_1$=10 degrees.

Figure 34:
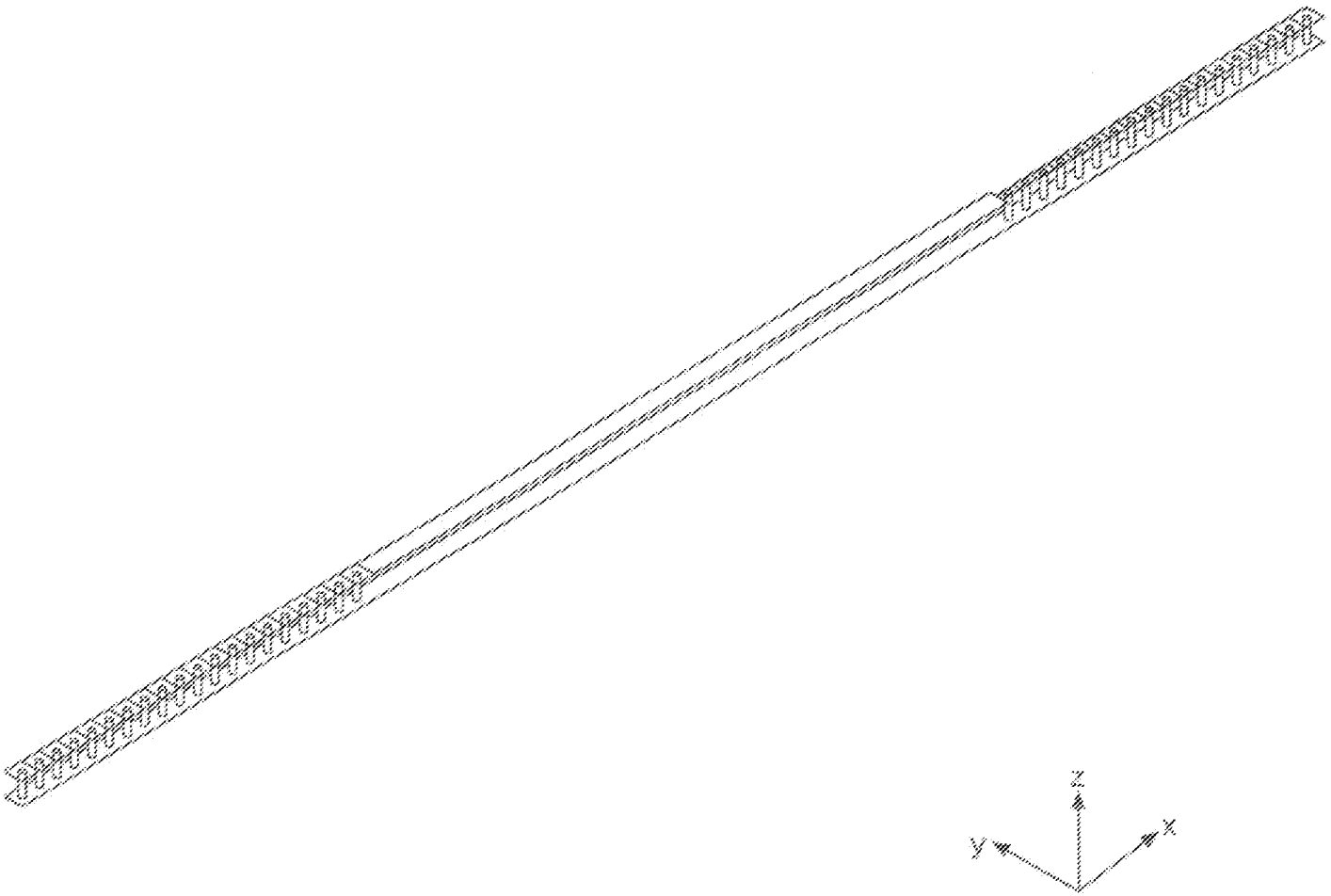
FIG. 34 is a perspective view of the analytical model that is used in a simulation (H10, metal plates 32, elements 38)
Figure 35:
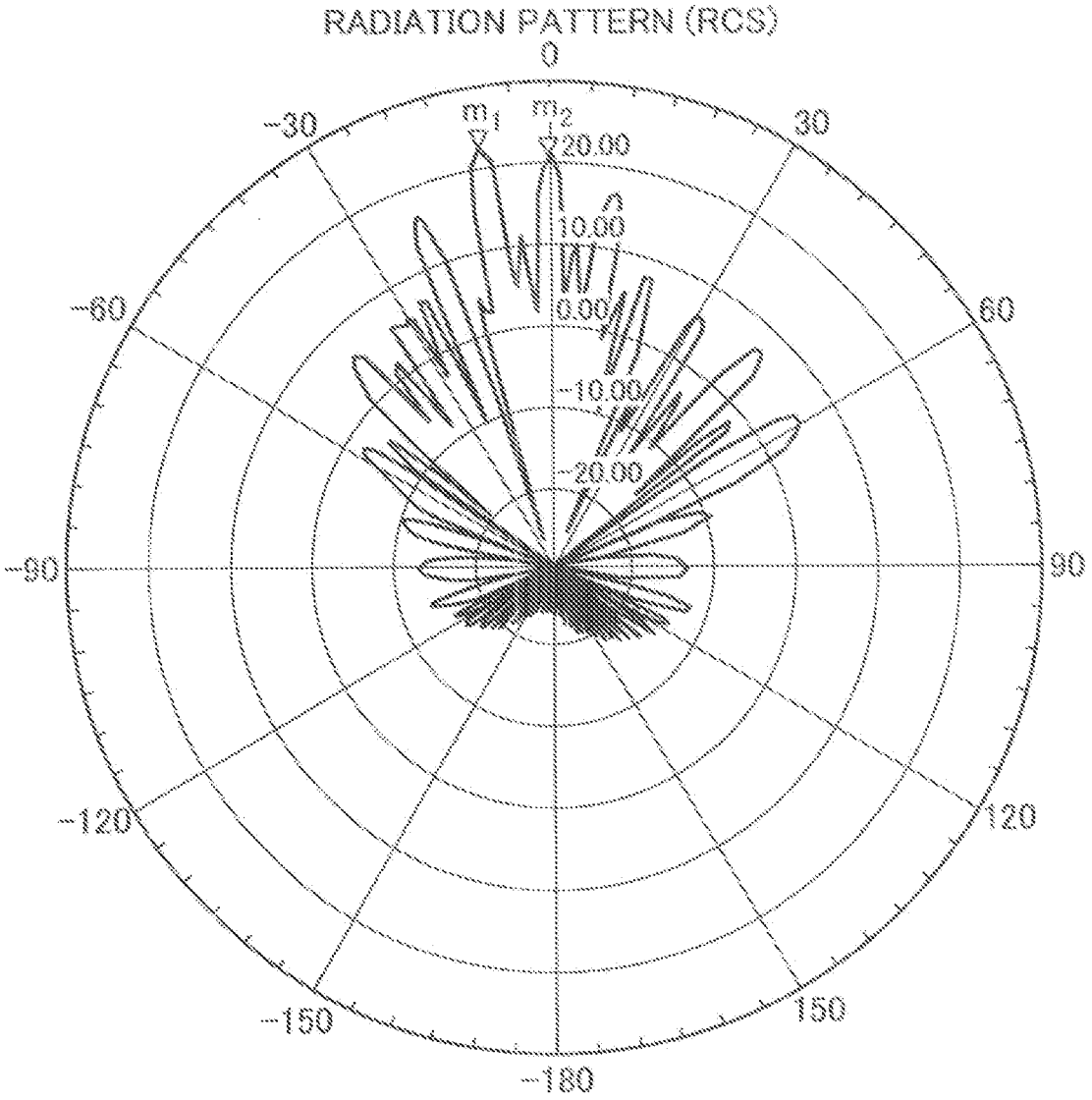
FIG. 35 is a diagram showing a result of the simulation (H10, metal plates 32, elements 38)

Similar to FIG. 32, FIG. 34 shows a simulation model for reflecting radio waves in the horizontal control. The simulation model is different from that of FIG. 32 in a point that the simulation model is for a case where reflected waves are reflected from $n_{\alpha1}$=38 pieces of the elements and from $n_{\alpha2}$=70−38=32 pieces of elements. FIG. 35 shows a result of the simulation that has been performed by using the model shown in FIG. 34. In the figure, the largest reflected wave m1 occurs in the direction of the first angle of reflection $\alpha_1$=10 degrees, and the strong reflected wave m2 occurs in the direction of the second angle of reflection $\alpha_2$=0 degrees. As shown in FIGS. 31, 33, and 35, as the number $n_{\alpha1}$ of the elements that contribute to the first angle of reflection $\alpha_1$=10 degrees increases, the intensity of the radio waves reflected in the direction of the first angle of reflection $\alpha_1$=10 degrees increases, while the intensity of the radio waves reflected in the direction of the second angle of reflection $\alpha_2$=0 degrees decreases.

Figure 36:
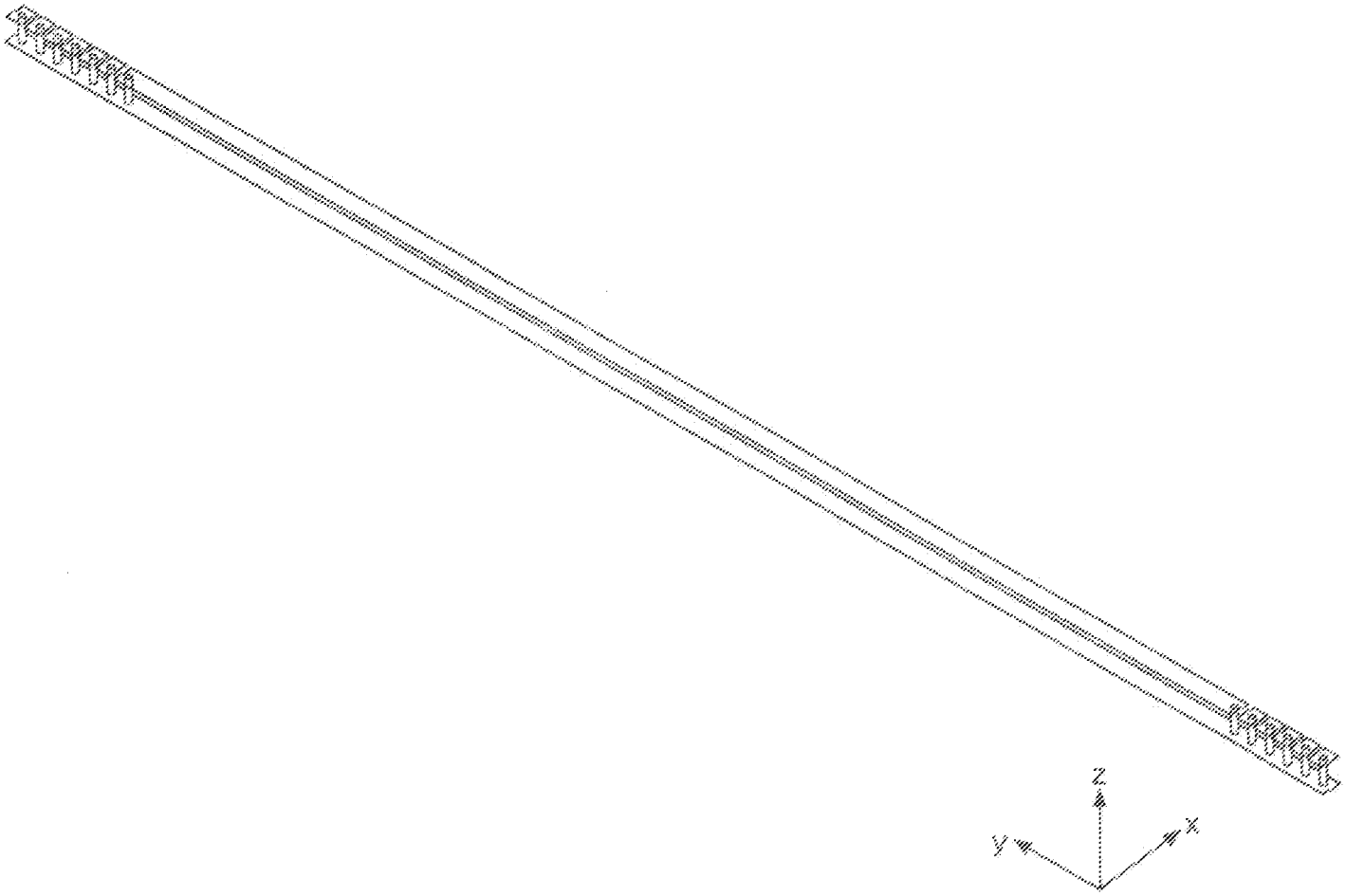
FIG. 36 is a perspective view of the analytical model that is used in a simulation (V10, metal plates 58, elements 12)
Figure 37:
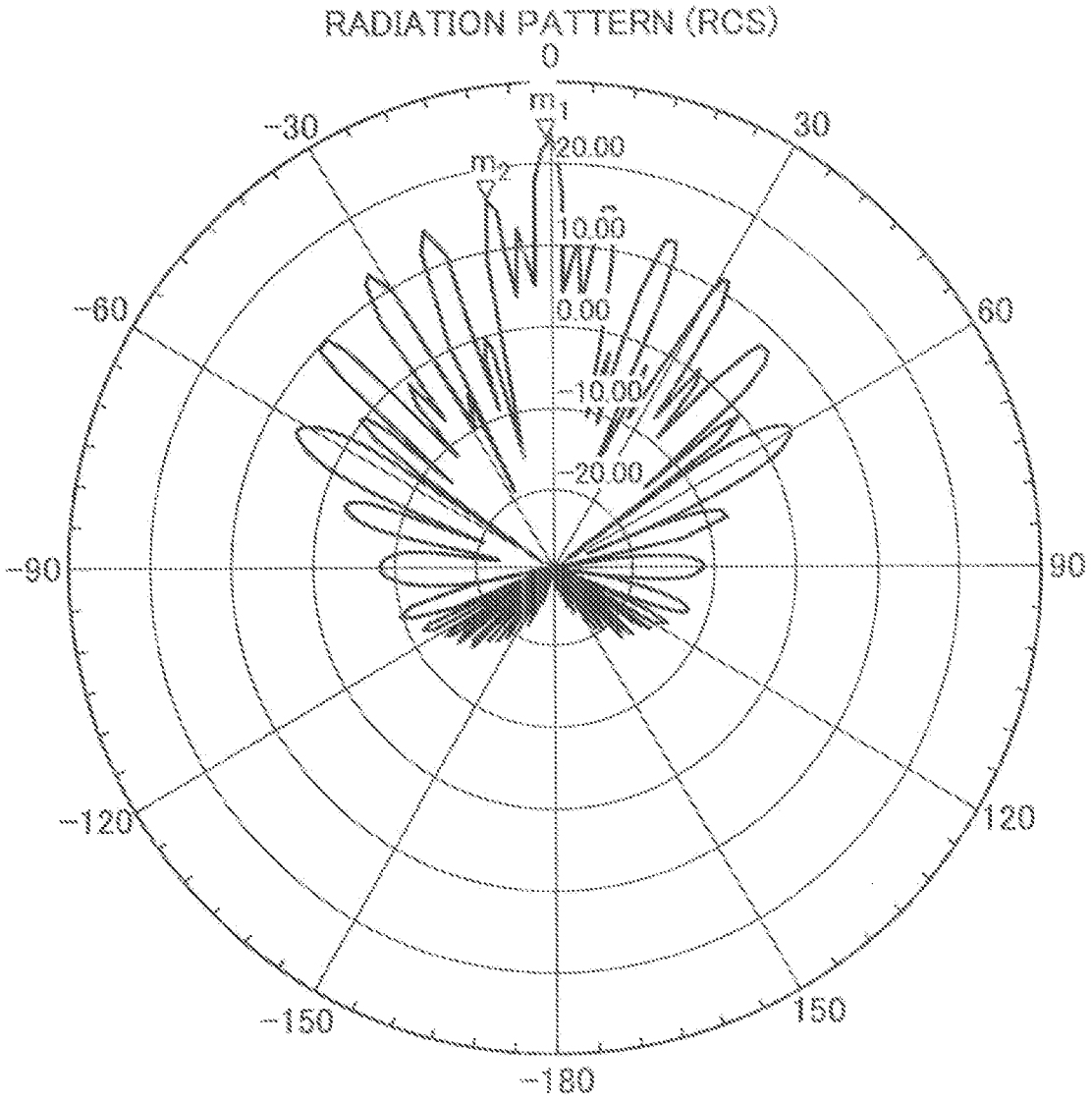
FIG. 37 is a diagram showing a result of the simulation (V10, metal plates 58, elements 12)

FIGS. 36-39 are similar to FIGS. 32-35, but FIGS. 36-39 are different in a point that the vertical control is performed. FIG. 36 shows a simulation model for reflecting radio waves from $n_{\alpha1}$=12 pieces of the elements and from $n_{\alpha2}$=70−12=58 pieces of elements in the vertical control. The sizes of the elements that contribute to the first angle of reflection $\alpha_1$=10 degrees are defined, so that the reflection phases of the elements correspond to their positions. All the elements that contribute to the second angle of reflection $\alpha_2$=0 degrees are achieved by a metal plate. FIG. 37 shows a result of the simulation that has been performed by using the model shown in FIG. 36. In the figure, the largest reflected wave m1 occurs in the direction of the second angle of reflection $\alpha_2$=0 degrees, and the second strongest reflected wave m2 occurs in the direction of the first angle of reflection $\alpha_1$=10 degrees.

Figure 38:
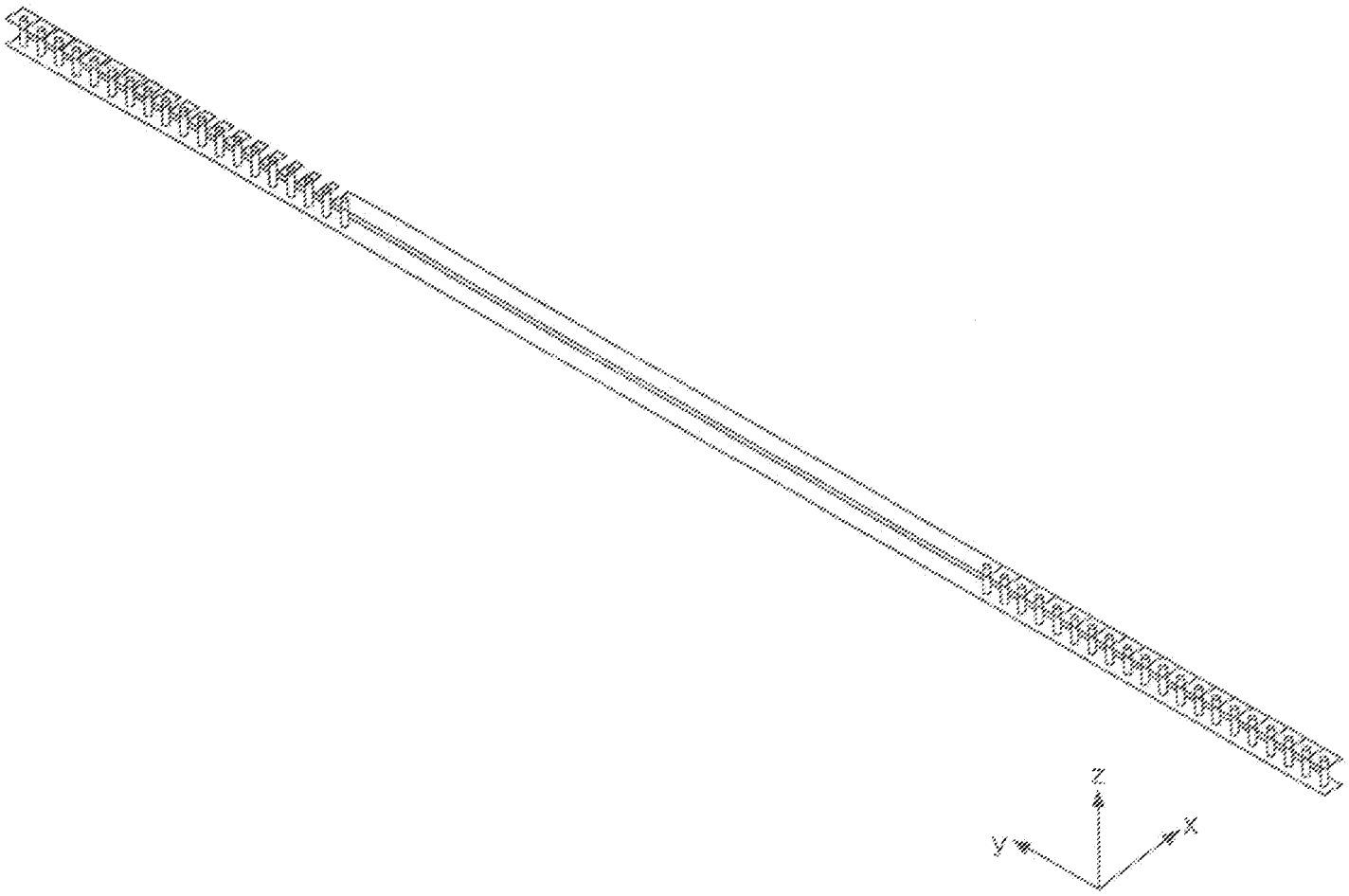
FIG. 38 is a perspective view of the analytical model that is used in a simulation (V10, metal plates 32, elements 38)
Figure 39:
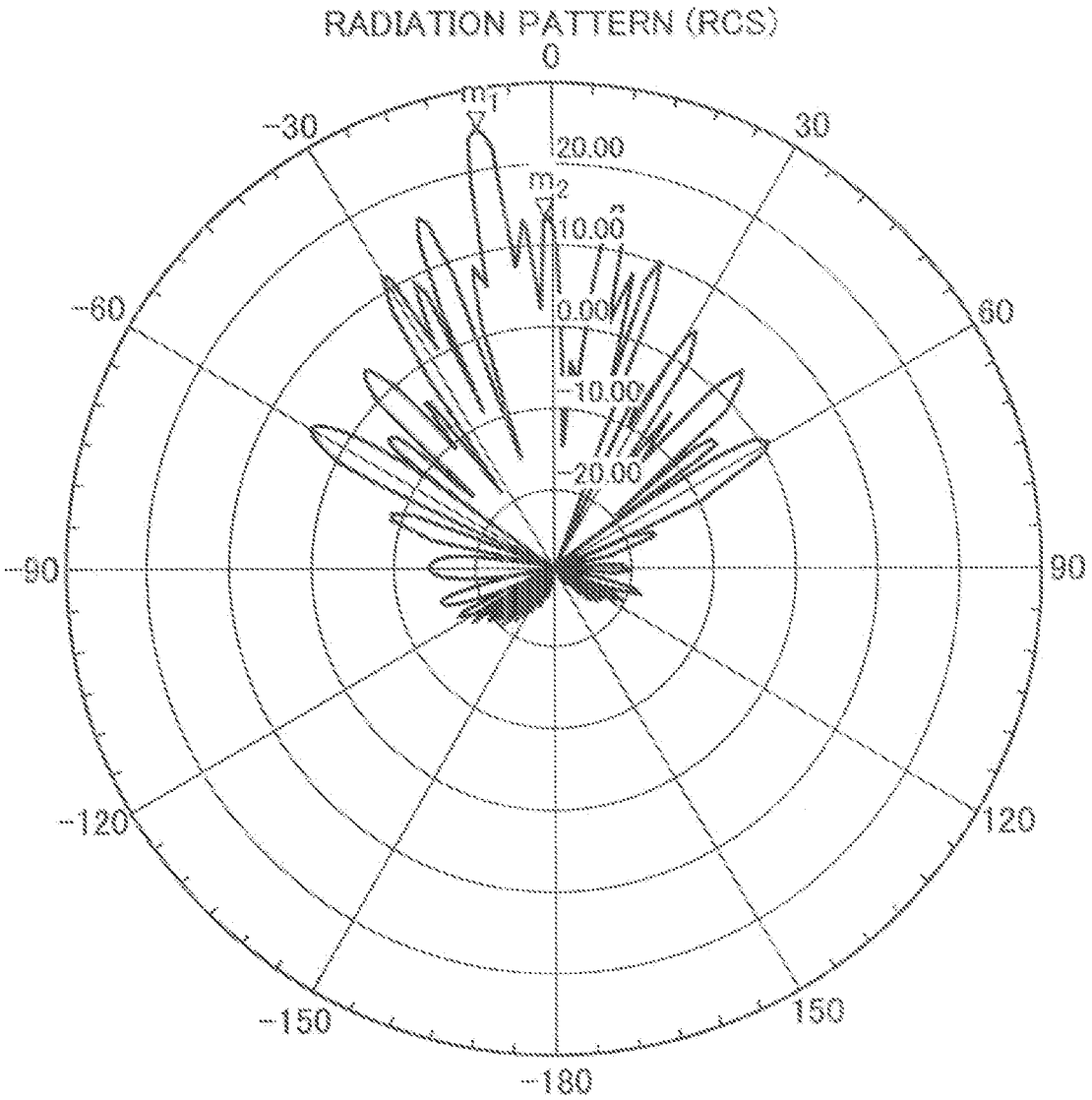
FIG. 39 is a diagram showing a result of the simulation (V10, metal plates 32, elements 38).

Similar to FIG. 36, FIG. 38 shows a simulation model for reflecting radio waves in the vertical control. However, the simulation model of FIG. 38 is different in a point that the simulation model is for reflecting the radio waves from $n_{\alpha1}$=38 pieces of the elements and from $n_{\alpha2}$=70−38=32 pieces of the elements. FIG. 39 shows a result of the simulation that has been performed by using the model shown in FIG. 38. In the figure, the largest reflected wave m1 occurs in the direction of the first angle of reflection $\alpha_1$=10 degrees, and the second strongest reflected wave m2 occurs in the direction of the second angle of reflection $\alpha_2$=0 degrees. As shown in FIGS. 31, 37, and 39, as the number $n_{\alpha1}$ of elements that contribute to the first angle of reflection $\alpha_1$=10 degrees increases, the intensity of the radio waves reflected in the direction of the first angle of reflection $\alpha_1$=10 degrees increases, while the intensity of the radio waves reflected in the direction of the second angle of reflection $\alpha_2$=0 degrees decreases.

In this manner, in any of the horizontal control and the vertical control, a ratio between a level of the reflected waves in the $\alpha_1$ direction and a level of the reflected waves in the $\alpha_2$ direction can be controlled by controlling a ratio of the elements for achieving specific reflected waves.

5. Modified Examples

5.1 An Alternative Example of the Elements

Figure 22:
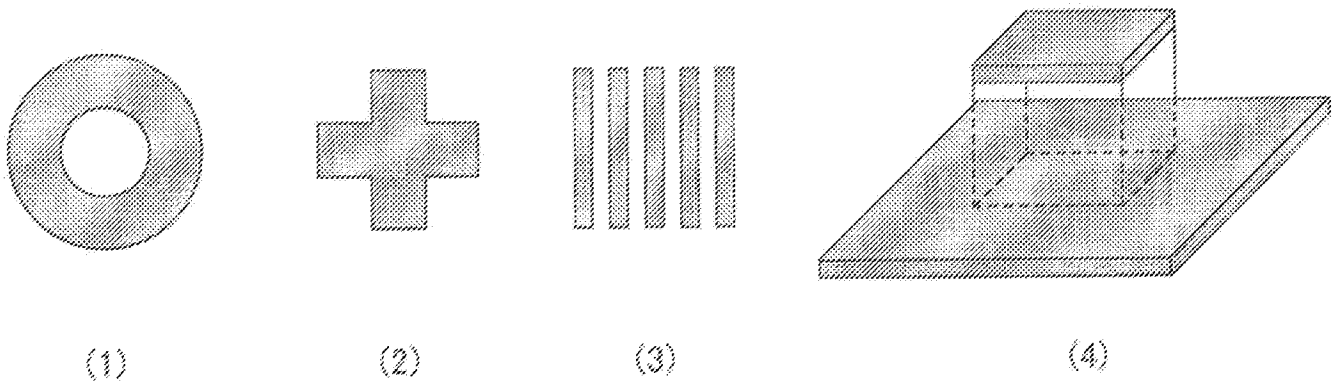
FIG. 22 is a diagram showing alternative examples of the structure of the element.

In the above explanations, the elements forming the multi-beam reflectarray have the mushroom-like structures shown in FIG. 5. However, any suitable elements that can reflect radio waves may be used. For example, alternatively to the patch having the square shape, an element having a ring-shaped electrically conductive pattern ((1) of FIG. 22), an element having a cross-shaped electrically conductive pattern ((2) of FIG. 22), or an element having plural electrically conductive patterns arranged in parallel ((3) of FIG. 22) may be used. Further, a structure may be used such that, in the mushroom-like structure, there are no vias connecting the patch and the ground plate ((4) of FIG. 22). Here, it is preferable to adopt the mushroom like structure as in the above-described embodiments, from a point of view that a smaller structure can be easily designed.

5.2 Shifting a Graph

The reflection phases of the corresponding plural elements forming the multi-beam reflectarray are determined by using the graph such as shown in FIG. 12. In this case, for an element placed at a specific position, there are a case where no achievable reflection phases exist, a case where only one achievable reflection phase exists, and a case where there are two achievable reflection phases. When there are three or more desired angles of reflection, it is possible that three or more choices occur. This is because, it is based on the graph such as shown in FIG. 11. In the example shown in FIG. 11, in both the graph of the first angle of reflection and the graph of the second angle of reflection, an initial phase of 0 degrees in the reflection phases is achieved by the first element. However, it is not required that the initial phase be achieved by the first element. That is because the reflection phases are relative to the elements, and it suffices if the predetermined reflection phases are achieved by the whole of 60 pieces (actually, less than 60 pieces) of the elements. Namely, between the two graphs shown in FIG. 11, one of them may be cyclically shifted in the direction of the horizontal axis relative to the other.

Figure 23:
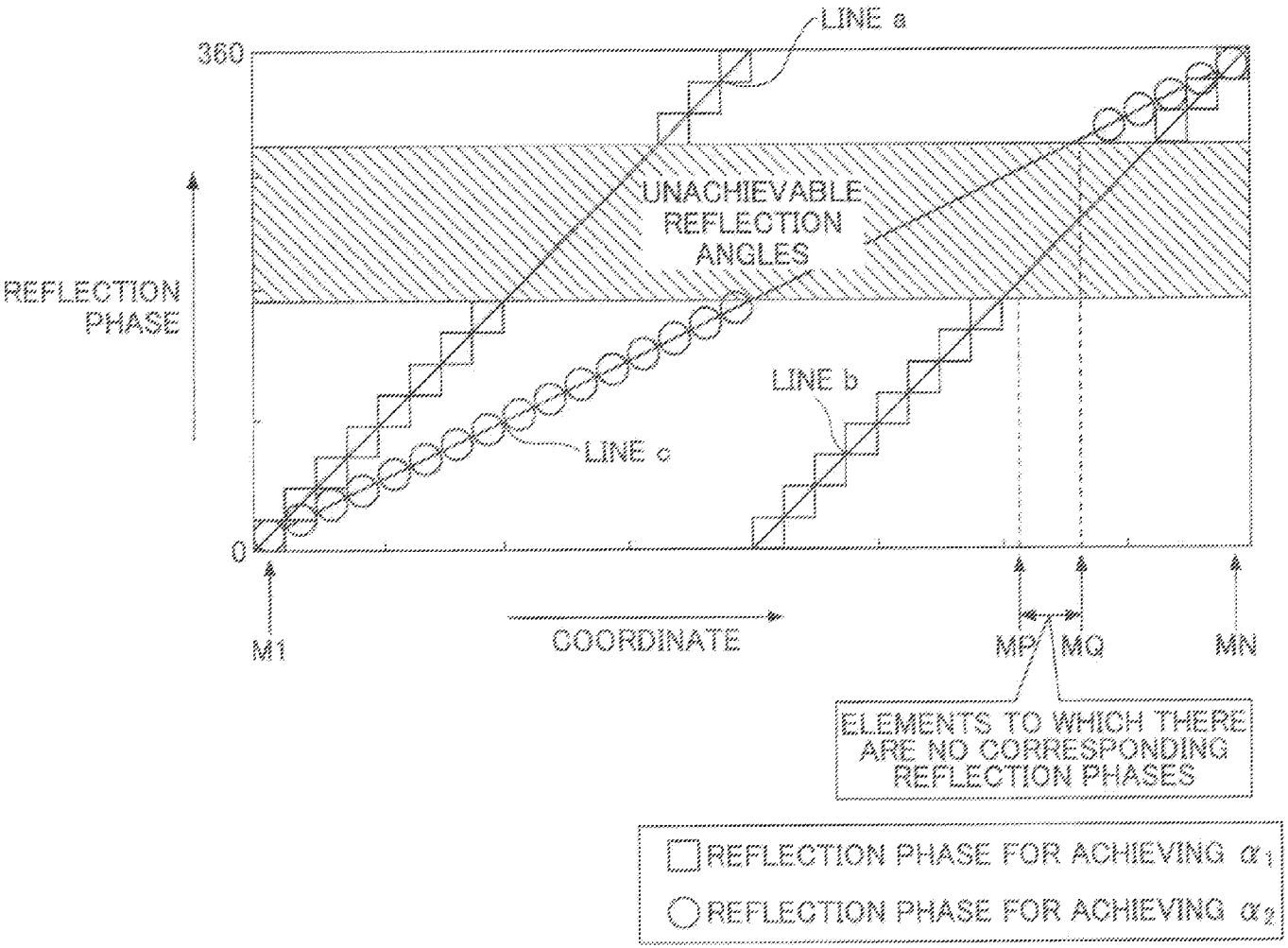
FIG. 23 is a diagram showing a graph that indicates a relationship between positions of the elements and the reflection phases.

FIG. 23 is a graph that simplifies the graph such as shown in FIG. 11. The reflection phases for achieving the angle of reflection $\alpha_1$ are shown along the line a and the line b (rectangular marks). The reflection phases for achieving the angle of reflection $\alpha_2$ are shown along the line c (circular marks). In the example shown in the figure, there are no corresponding reflection phases for the elements located at positions from MP to MQ. Accordingly, if it is designed as it is, these elements do not contribute to any angles of reflection.

Figure 24:
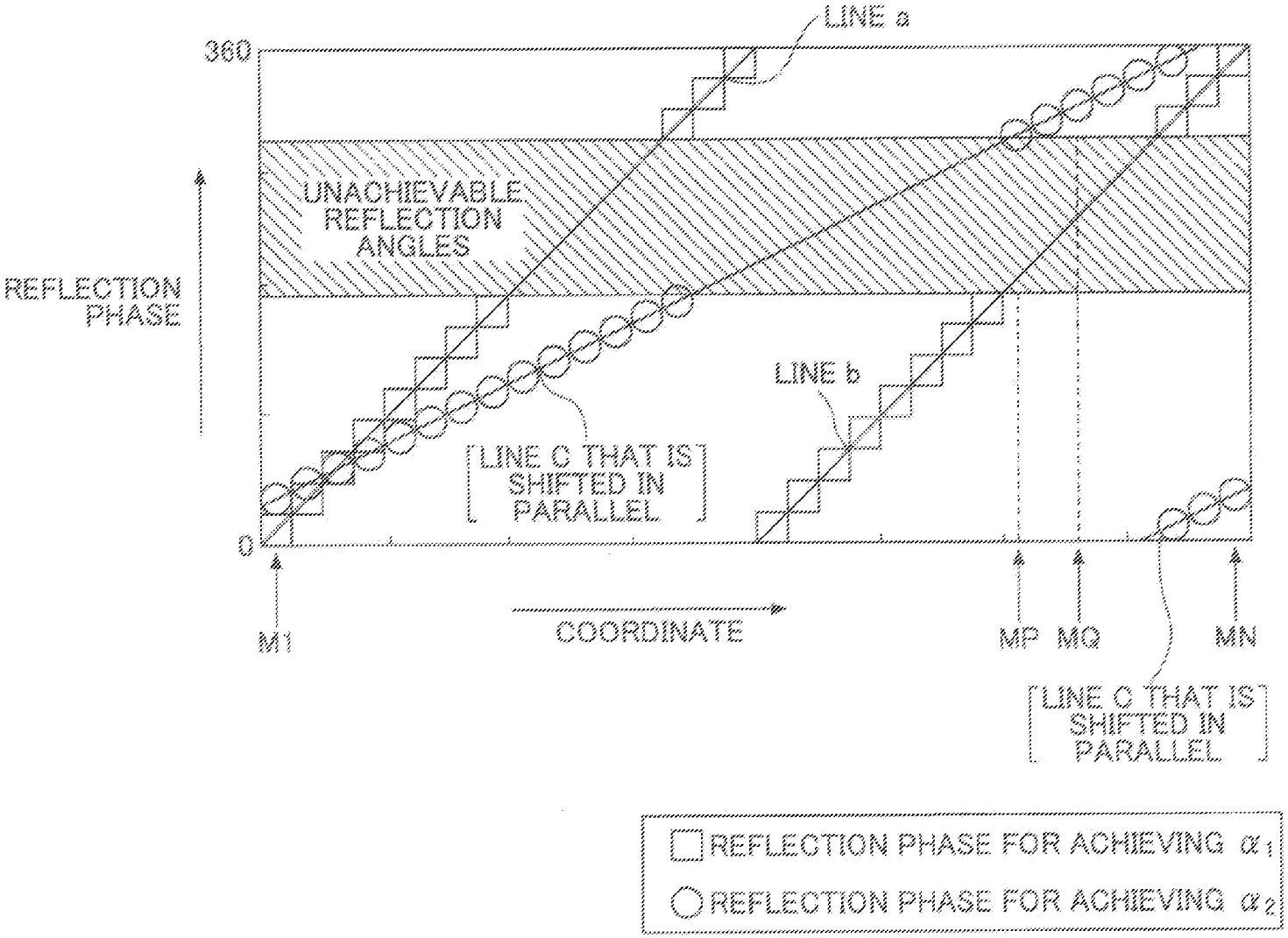
FIG. 24 is a diagram showing a state where the graph is shifted, where the graph indicates the relationship between the positions of the elements and the reflection phases.

FIG. 24 shows a state where the line c is shifted in a minus direction of the coordinate axis direction in the graph of FIG. 23. In this case, for the elements placed between MP and MQ, corresponding reflection phases exist on the line c. The line c represents the reflection phases for achieving the second reflection angle $\alpha_2$. Thus, it is possible to set the reflection phases of the elements placed from MP to MQ, so that the elements placed between MP and MQ contribute to the second angle of reflection $\alpha_2$. For the case of the example shown in FIG. 24, since all the elements have the corresponding reflection phases, any elements can contribute to some reflected waves in some manner. In the example shown in the figure, the graph is shifted, so that the number of the elements for which the corresponding reflection phases do not exist is reduced (eliminated). However, this is not required. Conversely, the graph may be shifted, so that the number of the elements for which the corresponding reflection phases do not exist is increased. For example, by placing metal plates at the positions of the elements for which the corresponding reflection phases do not exist, the intensity of the specular reflection may be intensified.

5.3 Examples of Arrangements of the Elements

For a case where radio waves are reflected in two directions of the first angle of reflection $\alpha_1$ and the second angle of reflection $\alpha_2$, a multi-beam reflectarray that reflects beams in the two directions can be formed by repeatedly arranging element arrays. Each of the element arrays includes a first element group for which the reflection phases are set so as to achieve the first angle of reflection $\alpha_1$ and a second element group for which the reflection phases are set so as to achieve the second angle of reflection $\alpha_2$. The methods of arranging the elements are as described above. However, the invention disclosed by the present application is not limited to such embodiments, and an example of an arrangement below may be used.

Figure 25:
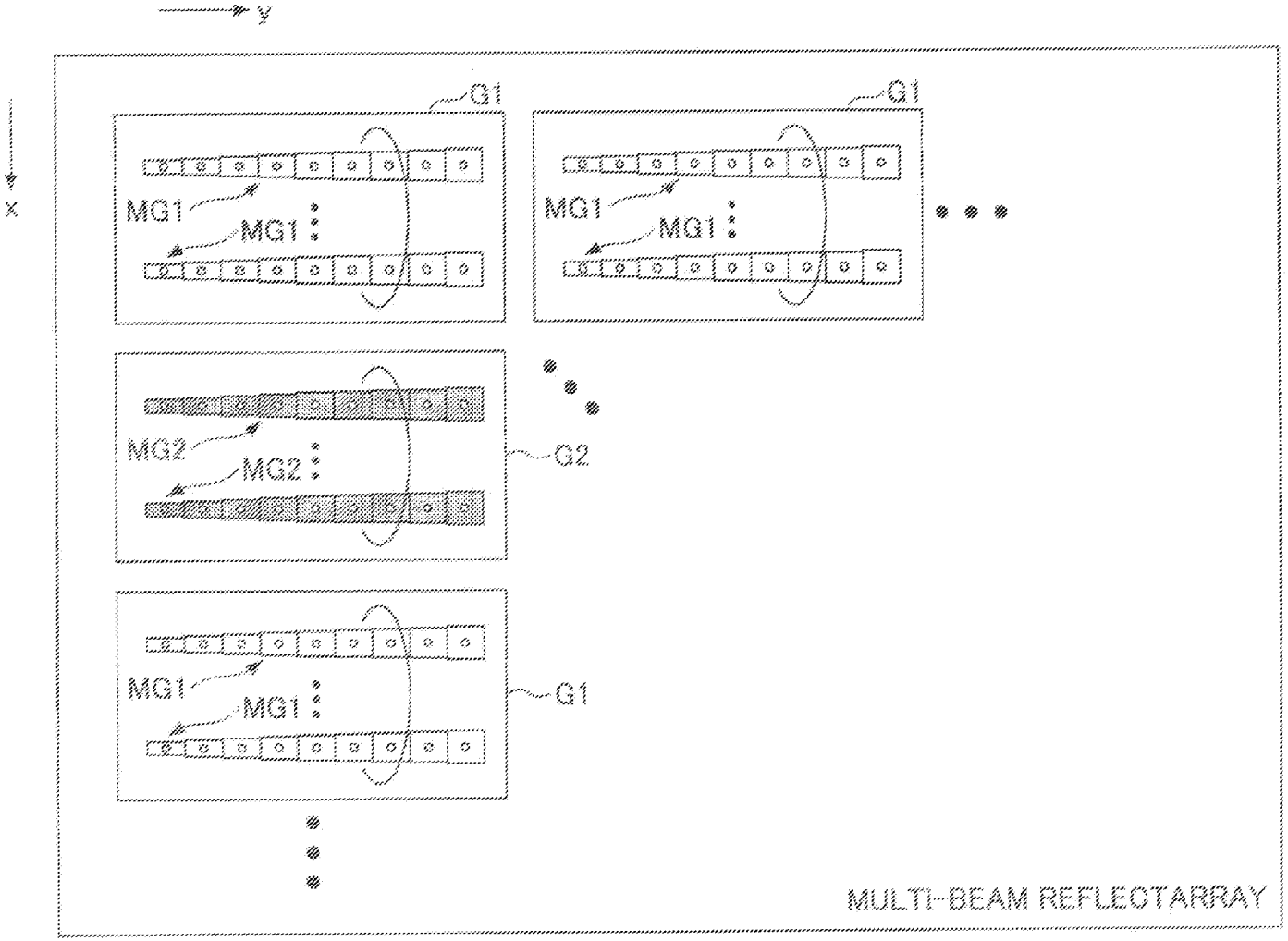
FIG. 25 is a diagram showing an example of an arrangement of the elements.

FIG. 25 shows a specific example of arranging plural element arrays. In the multi-beam reflectarray of the example shown in the figure, the first groups G1 are repeatedly arranged in the y-axis direction. Each of the first groups G1 includes two or more first element arrays MG1. The reflection phases of the elements belonging to the first element array MG1 are set, so that radio waves are reflected in directions corresponding to one or more angles of reflection. Further, in the multi-beam reflectarray shown in the figure, the second groups G2 are arranged adjacent to the first groups G1. Each of the second groups G2 includes two or more second element arrays MG2. The reflection phases of the elements belonging to the second element array MG2 are set, so that radio waves are reflected in directions corresponding to one or more angles of reflection. Here, at least one of reflection phase of the element belonging to the second element array MG2 is different from the reflection phases of the elements belonging to the first element array MG1. The example shown in FIG. 25 is intended for performing the horizontal control. However, the element arrays may be arranged so that the vertical control, which is explained while referring to FIGS. 26-29, is performed.

For example, the first element array MG1 may include only a first element group to which reflection phases are set so as to achieve reflected waves in the first angle of reflection $\alpha_1$, and the second element array MG2 may include only a second element group to which reflection phases are set so as to achieve reflected waves in the second angle of reflection $\alpha_2$. In this case, the reflected waves in the first angle of reflection $\alpha_1$ are formed by the first group G1, and the reflected waves in the second angle of reflection $\alpha_2$ are formed by the second group G2. Radio waves can be reflected in the two directions in the first angle of reflection $\alpha_1$ and in the second angle of reflection $\alpha_2$ by mixedly arranging the first groups G1 and the second groups G2 in the multi-beam reflectarray.

Alternatively, the first element array MG1 and the second element array MG2 may be designed, so that each of the first element array MG1 and the second element array MG2 reflects the radio waves in the two directions. For example, it may be designed so that the reflected waves in the first angle of reflection $\alpha_1$ are prioritized over the reflected waves in the second angle of reflection $\alpha_2$ in the first element array MG1, and conversely the reflected waves in the second angle of reflection $\alpha_2$ are prioritized over the reflected waves in the first angle of reflection $\alpha_1$ in the second element array MG2. When the number $n_{k1}$ of the elements to which the reflection phases are set so as to realize the first angle of reflection $\alpha_1$ is greater than the number $n_{k2}$ of the elements to which the reflection phases are set so as to realize the second angle of reflection $\alpha_2$, the reflected waves in the first angle of reflection $\alpha_1$ are prioritized over the reflected waves in the second angle of reflection $\alpha_2$. For example, by using the method explained by referring to FIGS. 13 and 14, one of the reflected waves may be prioritized.

Here, it suffices, in general, if the number of the element arrays MG1 included in the first group G1 and the number of the element arrays MG2 included in the second group G2 are greater than or equal to two. However, it is preferable that the number of the element arrays MG1 included in the first group G1 and the number of the element arrays MG2 included in the second group G2 are greater than or equal to three. That is because, as explained by referring to FIGS. 6 and 7, the capacitance C that defines the reflection phases of the elements significantly depends on the gap (space) between the neighboring patches, and the gap is formed between two element arrays.

Further, the definitions of the first range R1 and the second range R2 may be equal with respect to all the element arrays for the case where the above described third method is used. However, different definitions may be used for corresponding different element arrays. For example, in a first sequence of gaps (which is a sequence of gaps formed between two element arrays MG1) in the first group G1, the first range R1 may be defined to be 0-180 degrees and the second range R2 may be defined to be 180-360 degrees, while in a second sequence of gaps (which is a sequence of gaps formed between another two element arrays MG1) in the first group G1, the first range R1 may be defined to be 180-360 degrees and the second range R2 may be defined to be 0-180 degrees. Dividing the range of the reflection phase of 360 degrees=$2\pi$ is for exemplifying purpose only. The ranges of the reflection phase to which the third method is applied may be set to be any number of mutually exclusive ranges for the same element array.

Hereinabove, the multi-beam reflectarrays are explained by the embodiments. However, the present invention is not limited to the above-described embodiments, and various modifications and improvements may be made within the scope of the present invention. For convenience of the explanation, the above embodiments are explained from the viewpoint of the reflectarray having the mushroom-like structures. However, the present invention is not limited to such embodiments, and the present invention may be used in a different situation. For example, the present invention may be used in various situations such as the left-hand transmission line theory, metamaterials, design of a reflectarray in which electromagnetic bandgap (EBG) structures are utilized, techniques for improving a propagation environment to which a reflectarray is applied, and techniques for controlling a direction of reflected waves to which a reflectarray is applied. Further, in the above explanations, the multi-beam reflectarrays reflect the incident waves in plural directions. Conversely, the multi-beam reflectarrays may reflect radio waves coming from plural directions in a single direction. Specific examples of numerical values are used, in order to facilitate understanding of the invention. However, these numerical values are simply illustrative, and any other appropriate values may be used, except as indicated otherwise. Specific examples of expressions are used, in order to facilitate understanding of the invention. However, these expressions are simply illustrative, and any other appropriate expressions may be used, except as indicated otherwise. The separations of the embodiments or the items are not essential to the present invention, and subject matters described in two or more embodiments or items may be combined and used, and subject matters described in an item may be adopted for subject matters described in another item (provided that they do not contradict), depending on necessity.

The present application claims priority based on Japanese Patent Application No. 2011-185848, filed on Aug. 29, 2011, the entire contents of which are hereby incorporated by reference.

LIST OF REFERENCE SYMBOLS

M1-MN: Elements
51: Ground plate
52: Via
53: Patch
$\alpha_1$: First angle of reflection
$\alpha_2$: Second angle of reflection

The invention claimed is:

1. A multi-beam reflectarray comprising:

two or more element arrays, each of the element arrays including plural elements aligned along a predetermined direction;

wherein, in each of a first element group and a second element group included in at least one of the element arrays, a difference between phases of first radio waves reflected by corresponding two elements is in proportion to a first product of a distance between the two elements and a value of a trigonometric function with respect to an angle of reflection by the two elements, and wherein a first distance between first neighboring elements in the first element group is equal to a second product of a rational number and a second distance between second neighboring elements in the second element group.

2. The multi-beam reflectarray according to claim 1, wherein, in each of the first element group and the second element group, the difference between the phases of the first radio waves reflected by the corresponding two elements $\Delta\phi_i$, the distance between the two elements $\Delta y_i$, and the angle of reflection by the two elements $\alpha_i$ satisfy a first relation $\Delta\phi_i = k \times \Delta y_i \times \sin(\alpha_i)$, and wherein, i is a parameter designating an element group, and k a wavenumber.

3. The multi-beam reflectarray according to claim 2, wherein a ratio between a first element number $n_{k1}$ of the elements included in the first element group and a second element number $n_{k2}$ of the elements included in the second element group is determined to be a predetermined number.

4. The multi-beam reflectarray according to claim 3, wherein the rational number $m_j$, the first element number $n_{k1}$, and the second element number $n_{k2}$ satisfy a second relation $m_j = [n_{k1} \times \sin(\alpha_1)]/[n_{k2} \times \sin(\alpha_2)]$.

5. The multi-beam reflectarray according to claim 4, wherein the element array includes the first element group to a J-th element group, wherein the element array has a periodic structure such that a first number of the elements form one unit, the first number being equal to a least common multiple of numbers ($n_{k1}$, . . . , $n_u$) of the elements included in the corresponding element groups, and wherein the J is a natural number greater than or equal to 2.

6. The multi-beam reflectarray according to claim 5, wherein, in any of the two or more element arrays, the first element number $n_{k1}$ of the elements included in the first element group is greater than the second element number $n_{k2}$ of the elements included in the second element group.

7. The multi-beam reflectarray according to claim 5, wherein the first element group or the second element group includes at least two elements that reflect corresponding second radio waves, second phases of the second radio waves being equal to each other.

8. The multi-beam reflectarray according to claim 1, wherein a ratio among levels of reflected and scattered electric fields in corresponding angles of reflection is determined depending on proportions of numbers of the elements corresponding to the angles of reflection $\alpha_1, \ldots, \alpha_J$.

9. The multi-beam reflectarray according to claim 1, wherein a plurality of first element arrays and a plurality of second element arrays are arranged in parallel, wherein each of the plurality of first element arrays includes the first element groups and the second element groups, and the number of the first element groups included in the first element array is greater than or equal to the number of the second element groups included in the first element array wherein each of the plurality of second element arrays includes the second element groups and the first element groups, and the number of the second element groups included in the second element array is greater than or equal to the number of the first element groups included in the second element array.

10. The multi-beam reflectarray according to claim 9, wherein three or more the first element arrays and three or more the second element arrays are arranged in parallel.

11. The multi-beam reflectarray according to claim 9, wherein, in each of the element arrays included in the plurality of first element arrays or in the plurality of second element arrays, first reflection phases of the elements included in the first element groups are set to be corresponding first values in a first range R1, the first range R1 being narrower than $2\pi$, and second reflection phases of the elements included in the second element groups are set to be corresponding second values in a second range R2, the second range R2 being exclusive to the first range and the second range R2 being narrower than $2\pi$.

12. The multi-beam reflectarray according to claim 1, wherein the plural elements aligned along the predetermined direction are formed of mushroom-like structures including, at least, a plurality of patches and a ground plate.

* * * * *